US008955688B2

(12) United States Patent
Berdelle-Hilge

(10) Patent No.: US 8,955,688 B2
(45) Date of Patent: Feb. 17, 2015

(54) SORTING INSTALLATION AND SORTING METHOD USING A GRIPPING TOOL

(75) Inventor: Peter Berdelle-Hilge, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/235,921

(22) PCT Filed: Jul. 23, 2012

(86) PCT No.: PCT/EP2012/064374

§ 371 (c)(1),
(2), (4) Date: Jan. 29, 2014

(87) PCT Pub. No.: WO2013/017449

PCT Pub. Date: Feb. 7, 2013

(65) Prior Publication Data

US 2014/0166550 A1 Jun. 19, 2014

(30) Foreign Application Priority Data

Jul. 29, 2011 (DE) ..... 10 2011 080 137

(51) Int. Cl.

| | |
|---|---|
| ***B07C 5/00*** | (2006.01) |
| ***B07C 3/02*** | (2006.01) |
| ***B65H 5/04*** | (2006.01) |
| ***B65H 5/10*** | (2006.01) |

(52) U.S. Cl.

CPC ... *B07C 5/00* (2013.01); *B07C 3/02* (2013.01); *B65H 5/04* (2013.01); *B65H 5/10* (2013.01); *B65H 2301/44716* (2013.01); *B65H 2701/1916* (2013.01)

USPC ..... 209/552; 209/617; 209/629; 198/465.4; 198/715

(58) Field of Classification Search

USPC ..... 209/552, 617, 629, 509; 198/465.4, 715

See application file for complete search history.

(56) References Cited

U.S. PATENT DOCUMENTS

| | | | | |
|---|---|---|---|---|
| 4,169,529 | A * | 10/1979 | Hunter | 198/465.4 |
| 6,221,195 | B1 * | 4/2001 | Lubert et al. | 156/275.7 |
| 6,257,821 | B1 | 7/2001 | Ward et al. | |
| 6,715,614 | B2 | 4/2004 | Pippin et al. | |
| 6,968,937 | B2 | 11/2005 | Mader et al. | |

(Continued)

FOREIGN PATENT DOCUMENTS

| | | | |
|---|---|---|---|
| DE | 10212086 | A1 | 10/2003 |
| EP | 1299298 | B1 | 4/2004 |

(Continued)

*Primary Examiner* — Terrell Matthews

(74) *Attorney, Agent, or Firm* — Laurence A. Greenberg; Werner H. Stemer; Ralph E. Locher

(57) ABSTRACT

A sorting installation and a sorting method use a gripping tool for gripping sorted articles, particularly sorted flat mail items. During sorting, the articles are transported in holding apparatuses having two lateral faces each. Each lateral face is preferably formed with one cutout. A supply station puts each article into one holding apparatus, with the result that the article is situated between the lateral faces and is held by the holding apparatuses. A transport apparatus transports the articles to a removal station and produces a sequence of holding apparatuses with articles being held thereby. The removal station has a gripping tool with at least two gripper arms in a gripper arm sequence. These gripper arms grip between filled holding apparatuses and draw a plurality of held articles from these holding apparatuses simultaneously.

8 Claims, 9 Drawing Sheets

(56) References Cited

U.S. PATENT DOCUMENTS

| | | | | |
|---|---|---|---|---|
| 7,138,596 | B2 | 11/2006 | Pippin et al. | |
| 7,820,932 | B2 | 10/2010 | Stemmle | |
| 8,457,781 | B2 | 6/2013 | Bailey et al. | |
| 2005/0189268 | A1 | 9/2005 | Zimmermann | |
| 2013/0266413 | A1* | 10/2013 | Bergmeier | 414/788.8 |
| 2014/0166550 | A1* | 6/2014 | Berdelle-Hilge | 209/552 |

FOREIGN PATENT DOCUMENTS

| | | | |
|---|---|---|---|
| EP | 1878511 | A1 | 1/2008 |
| WO | 2009035694 | A1 | 3/2009 |

* cited by examiner

SORTING INSTALLATION AND SORTING METHOD USING A GRIPPING TOOL

BACKGROUND OF THE INVENTION

Field of the Invention

The invention relates to a sorting installation and a sorting method using a gripping tool for gripping sorted articles in or on holding apparatuses, particularly sorted flat mail items in storage pouches.

BRIEF SUMMARY OF THE INVENTION

In order to achieve the object of sorting mail items of different dimensions, sorting installations having a plurality of holding apparatuses have repeatedly been proposed. Each holding apparatus can hold and transport one mail item. A holding apparatus ("holder") is embodied e.g. as a storage pouch ("storage pocket") or clamp arrangement ("clamp"). The mail items are put into the holding apparatuses, the holding apparatuses containing the mail items are sorted, and the mail items sorted in this manner are removed again from the holding apparatuses.

WO 2009/0356954 A1 describes a sorting installation for flat mail items. Each mail item is transported in its own holding apparatus ("frame"). Various embodiments are described for extracting a mail item again from such a holding apparatus ("frame F").

In one embodiment from WO 2009/035694 A1, a "rotatable shuttle 1011" removes mail items ("mail pieces M") from holding apparatuses ("frames F"), cf. FIG. 10B to FIG. 10D and section [0639]. The mail items M fall due to gravity out of the holders F and land between "separation paddles 1015", cf. section [0643]. In another embodiment, "articulating pushers 1021" reach into opened holding apparatuses F and push the mail items M out of these holding apparatuses F and toward "articulating robotic grippers 1023a and 1023b", cf. FIG. 10E to FIG. 10G and section [0652]. The "pushers 1021" have hooks at the front. The "grippers 1023a, 1023b" are in the form of forks.

In the embodiment from FIG. 11I of WO 2009/035694 A1, a plurality of mail items can be removed from their respective holding apparatuses simultaneously, cf. section [0744]. A rectangular "frame 11095" is furnished with four "tabs 11097" at the four corners, cf. section [0740]. A V-shaped "folder 11096" is connected by means of four "elastic bands 11101" to the "frame "11095", cf. sections [0742] and [0743]. "Holes 11103" are provided in the bottom of the "frame 11095" and the "folder 11096", through each of which a "rod 11104" is extended, cf. [section 0743]. The "rods 11104" are raised such that the mail items stand on the "rods 11104". The "rods 11104" are rotated and thereby push the mail items horizontally out of the holding apparatuses, cf. FIG. 11I and section [0746]. The mail items can also be removed from the holding apparatuses by means of vibration, cf. section [0747].

In one embodiment from WO 2009/035694 A1, a "frame 11115" has a "folder 11116" and four hook-shaped "actuation tabs 11118" and "11119" at the corners, cf. FIG. 11J and section [0749]. The "folder 11116" has two lateral faces ("front membrane 11116a, back membrane 11116b") which are connected to one another mechanically. In order to open the "folder 11116", the "actuation tabs 11118, 11119" are rotated from a vertical closed position to a horizontal open position and move the lateral faces 11116a, 11116b away from one another, cf. section [0752]. The "front membrane 11116a" contains a C-shaped cutout 11121, cf. FIG. 11J and section [0752]. A "vacuum pick-head" grips a mail item M in the "folder 11116" through this cutout 111121, cf. section [0752].

In another embodiment, the "back membrane 11116b" also has a C-shaped cutout. A plurality of "frames 11115" are transported past a stationary "vacuum pick-head", and the one "pick-head" grips the mail items M in the holding apparatuses through the C-shaped cutouts, cf. section [0753].

In the embodiment from FIG. 11Q of WO 2009/035694 A1, a mail item is inserted laterally into a holding apparatus and removed again laterally from the holder, cf. section [0795]. The rectangular "frame 11205" has four "tabs 11207, 11208" at the four corners. A "sub-frame 11206" is movably attached to the "frame 11205" at the top by means of two longitudinal "hinges 11213" and also by means of two longitudinal "hinges 11214", cf. section [0799]. The holding apparatus is open on two sides. An "end-effector" can grip and move a mail item in the holding apparatus from outside through a "cutout 11205", cf. section [0800]. The "end-effector" is for example a "vacuum pick-off head" or operates with the aid of friction, cf. section [0800]. A variety of positions can be considered for the "cutout 11215", cf. section [0801]. The holding apparatus can be unfolded e.g. by means of "actuator tabs", cf. section [0802].

FIG. 1 of EP 1299298 B1 shows a sorting installation which transports flat articles 2 on holding elements 1, in each case one article 2 per holding element 1. The holding elements 1 containing the articles 2 are transported along a section of rail 5 from a delivering unit 3 to a unit 4 which receives the articles again. The section of rail 5 guides the holding elements 1 through a feeding section 10, a buffer store 12 and a discharging section 11. In the buffer store 12, holding elements 1 are pooled into groups and delivered in groups to the subsequent discharging section 14.

In the example from FIG. 7 of EP 1299298 B1, three types of printed products are conveyed to three different buffer stores 12.1, 12.2, 12.3 and then delivered individually or in groups to a central buffer store 12. In the buffer store 12, groups 15 are generated, each group 15 consisting of the printed products for one package. In the example from FIG. 8, printed products 2 are output in the form of "sections 15.1". A separating sheet 50 is inserted between two consecutive sections 15.1. The sections 15.1 and separating sheets 50 are grouped into package stacks 15.2.

In U.S. Pat. No. 4,169,529, an apparatus is described which transports flat mail items with the aid of holding elements ("carriers 10"). Each holding apparatus 10 accommodates a letter ("letter 14") in a space which is formed by two side walls ("side members 18"), a lid ("upper section 20") and a base ("lower section 22"), cf. FIG. 4. Because these component parts are articulatedly connected with the aid of hinges 30, 30', 32, 32', a "carrier 10" can be folded together, cf. FIG. 4. Each of the two side walls 16, 18 contains an opening 34, 34'. FIG. 6 shows how a "carrier 10" is loaded and later unloaded. Empty "carriers 10" are transported to the left in the direction of the arrow 44, gravity folding the "carriers 10" together. The "carriers 10" are carried with their lower edges across two parallel endless conveyor belts 12. This causes the lower edges of the "carriers 10" to be raised and a "carrier 10" to be unfolded and to form a space into which a letter 14 is pushed. A loaded "carrier 10" slides down from the conveyor belt 12 again and is thereby folded together and holds the letter 14 between the two side walls 16,18 which then touch one another. In order to unload a loaded "carrier 10" again, the "carrier 10" is unfolded again with the aid of further endless conveyor belts 54. An "unloader belt 56" grips the letter 14 through an opening 34, 34' from the side. With the aid of vacuum pressure, the conveyor belt 56 sucks the letter 14 out of the "carrier 10".

U.S. Pat. No. 7,138,596 B2 describes a sorting installation and a sorting method. The "mail handling and sorting system 10" of FIG. 1 and FIG. 2 has two "feeders 14, 14a" for mail items and an "optical character reader (OCR) 24". A "loading station 12" puts mail items in "delivery robots 100". Each "delivery robot 100" transports mail items along a "track system 60" to "slots 72" of a "mail case 70". Each "delivery robot 100" inserts a mail item by means of an "inserter 142" into a "slot 72", cf. FIG. 3, FIG. 6. In order to be able to insert mail items of different sizes, the "inserter 142" has in one embodiment a plurality of parallel plates 250, 252, 254, 256, cf. FIG. 6. A plurality of belts around these plates 250, 252, 254, 256 can move a mail item into a "slot 72". A motor pushes the "inserter 142" itself to and fro.

U.S. Pat. No. 6,715,614 B2 describes a "multi-bag storage device 30", cf. FIG. 2. This storage unit 30 has a plurality of pouches ("bags") with flexible side walls. A flat mail item can be put into a bag through an opening 31 in each. FIG. 17 to FIG. 21 show another embodiment of a "multi-bag 100" with thin "bags 101". FIG. 9 to FIG. 13 show an embodiment of a "mail sorting case 70" having a plurality of "multi-bag devices 71". FIG. 14 to FIG. 17 show a "sorting station".

U.S. Pat. No. 6,257,821 B1 describes a "robotics part handler system". A "platform or base 19" carries an A-shaped frame ("A frame") 40 with a plurality of vertical "columns 44" which each have a plurality of "guide rails 46".

DE 10212086 A1 describes a sorting installation for presorting flat mail items. Two transport devices 3,4 operating in parallel each transport a flow of mail items along two parallel transport paths 1, 2 toward a loading device. A plurality of storage cells 5 are transported at constant speed and each accommodates a mail item 8 standing upright, cf. FIG. 1. A transport device 6, 7 unloads the storage cells 5 again. Each storage cell 5 has two lateral faces with inset parallel bars 10 and each having a slot 11, cf. FIG. 2. A punch 12 of the unloaded transport device 6, 7 pushes a mail item laterally in a horizontal direction and parallel to the lateral faces out of the storage cell 5. Thanks to the two parallel slots 11, the punch 12 can reach into the storage cell 5. An arrangement with two conveyor belts ("cover belt system 13") clamps the mail item 8 and transports it away after the punch 12 has pushed the mail item 8 out of the storage cell 5.

EP 1878511 A1 describes a sorting installation and a sorting method for sorting mail items into an order in two steps. In a first step, the mail items are divided into "batches". Each "batch" consists of mail items to a group of delivery addresses and is not yet sorted in itself. In a second step, the "batches" are sorted consecutively, in each case the mail items of one "batch" being sorted into order. A "batch sorting module" implements the first step, an "address sorting module" the second step. Each mail item is connected prior to sorting to a holder in the form of a "clamp" and transported on this "clamp" through the sorting installation used. In one embodiment, an "address sorting module" divides the incoming holders ("clamps") with mail items between 28 "address stations" for a maximum of 10 holders each, cf. FIG. 3G.

The object underlying the invention is to provide a sorting installation and a sorting method which sort a plurality of articles according to a predefined sort characteristic, each article being put into a holding apparatus and later removed from the holding apparatus again for this purpose, and the sorting installation used, by removing the articles, aiming to achieve a high throughput.

The object is achieved in a sorting installation as claimed and a sorting method as claimed. Advantageous embodiments are specified in the dependent claims.

Through the invention, a plurality of articles is sorted by means of a sorting installation according to a predefined sort characteristic. The sorting installation has

- a plurality of holding apparatuses, each for at least one article to be sorted, and
- a gripping tool having a plurality of gripper arms.

For each article to be sorted, the following steps are executed:

- A measuring device measures what value the sort characteristic assumes for this article.
- A supply station puts the article into or onto a holding apparatus of the sorting installation such that the holding apparatus holds the article and can be transported together with this article.
- A removal station with the gripping tool later removes the article again from this holding apparatus or otherwise separates the article again from the holding apparatus such that the holding apparatus no longer holds the article. Here, the article is gripped by two gripper arms of the gripping tool, from two sides such that the two gripper arms temporarily clamp the article between them. A relative movement of at least these two gripper arms relative to the holding apparatus with the articles is executed. The article is separated from the holding apparatus again by this means.

The articles are sorted, a sorting and transporting device putting the holding apparatuses together with the held articles into a sequence. This established sequence of the holding apparatuses depends on the measured sort characteristics of the articles which are held by the transported holding apparatuses. At least one holding-apparatus sequence of filled holding apparatuses is produced by the sorting. The sorting and transporting device transports the holding apparatuses containing the held articles from the supply station to the removal station.

According to the solution, the gripping tool has at least two gripper arms which are arranged in a gripper-arm sequence. The gripping tool simultaneously grips at least two held articles in or on a holding apparatus or two held articles in two different adjacent holding apparatuses, two adjacent gripper arms in the gripper-arm sequence gripping in each case at least one article in a holding apparatus. The at least two gripper arms of the gripping tool therefore grip a total of at least two articles which are currently held by holding apparatuses.

Due to this relative movement of the gripper arms relative to the filled holding apparatuses, all the articles which are each held by at least two gripper arms are simultaneously removed from the holding apparatuses or otherwise separated from the holding apparatuses, i.e. at least two articles.

It is possible for two adjacent gripper arms to grip more than two articles simultaneously or for more than two gripper arms simultaneously to grip a plurality of articles. It is also possible for two adjacent gripper arms to grip at least two articles in or on two adjacent holding apparatuses. It is also possible for the gripper arms to make a gripping movement by means of which articles in two holding apparatuses can be gripped, but for one of these holding apparatuses to be currently empty.

The sorting installation according to the solution can sort articles of different dimensions because each article to be sorted is put into one holding apparatus, and the holding apparatus is transported together with the held article. The gripping tool removes in each case a plurality of articles at once from their respective holding apparatuses, after the holding apparatuses containing the articles have been sorted. In this way, the throughput and the processing rate during unloading are increased considerably compared with a procedure in which the articles are removed from the holding apparatuses consecutively.

The holding apparatuses containing the articles to be sorted have already been brought into a sequence when the unloading of the holding apparatuses commences. According to the solution, the gripping tool can grip at least two articles at once. Because a plurality of articles are gripped at once, the step of unloading the holding apparatuses or otherwise separating the holding apparatuses from the articles requires less time than if each holding apparatus were to be unloaded singly and the holding apparatuses were therefore to be unloaded strictly sequentially. Because the holding apparatuses are already sorted, sorting is no longer required after unloading.

Two adjacent gripper arms grip at least one article in or on a holding apparatus and clamp it temporarily between them. The article is thus held by an exertion of force from two sides. The invention is therefore particularly suitable for articles which each extend in one article plane, in particular for flat mail items ("letters" and "flats") or other flat articles to be sorted. The two gripper arms each exert a force which is perpendicular to the article plane. Because the two gripper arms grip the article from two sides, the force which the one gripper arm exerts on the article is absorbed by the other gripper arm in each case. For this reason, neither the gripped article nor the holding apparatus from which this article is to be removed or from which the article is to be separated is bent or otherwise mechanically loaded. This risk would exist if the article were to be gripped or else sucked from one side only.

Because the gripper arms grip an article from two sides, the gripping tool can be designed and implemented without knowledge of the surface condition of an article to be gripped. In particular the elasticity or the roughness of the surface or a frictional characteristic of the surface do not need to be known. This is particularly advantageous where different types of articles are to be sorted and it is not known in advance of which types these articles are in each case.

The gripper arms can be small in dimension—viewed in a direction perpendicular to the transport direction in which the holding apparatuses are transported. As a result, a removal station can be implemented that requires little space. A multiplicity of articles can be removed simultaneously.

Thanks to the gripper arms, the invention saves on the need for a conveyor belt and a vacuum generator. The gripper arms can be fashioned much more narrowly than a conveyor belt, which has to be guided around a plurality of rollers and must itself have a certain thickness, and also more thinly than a vacuum generator, which sucks an article in or on a holding apparatus.

Thanks to the gripper arms, it is possible, but not necessary to alter the holding apparatus for the purpose of removing an article from the holding apparatus. In particular, it is not necessary to unfold a holding apparatus for unloading. As a result, holding apparatuses without hinges can also be used.

According to the solution, an article is removed from a holding apparatus in that two adjacent gripper arms of the sequence grip the article from two sides and temporarily clamp the article between them. The distance between the two adjacent gripper arms can be decreased and increased. In this way, an article can be gripped and released again. It is not necessary for a holding apparatus to have a component for actively removing an article from the holding apparatus. In particular, the holding apparatus does not need to have a pusher and a conveyor belt. This is particularly advantageous because the sorting installation normally has a multiplicity of holding apparatuses but needs to have only one gripping tool.

It is possible but not necessary to cause a holding apparatus to vibrate while the holding apparatus is holding the article. Thanks to the use of the gripping tool according to the solution, it is possible to remove an article from a holding apparatus without having to raise the article in the holding apparatus before removing it.

It is furthermore possible but not necessary for the holding apparatus to have an unloading hatch or a flap at the base for emitting an article downward. Rather, an article is drawn by two gripper arms out of a holding apparatus without a flap of the holding apparatus having to be opened for this purpose. The holding apparatuses can therefore be simple in structure. This is particularly advantageous where the supply station puts each article into a previously empty holding apparatus, and the sorting installation therefore has at least as many holding apparatuses as there are articles to be sorted.

Thanks to the invention, it is possible but not necessary for a side wall of the holding apparatus to be connected articulatedly to another component part of this holding apparatus. Such an articulated connection ("hinged connection") makes it possible to make the space in the interior of the holding apparatus larger and smaller, in particular wider and narrower, in order to insert and remove a flat article in the enlarged space and in order to hold and transport the article in the reduced space securely. Thanks to the gripping tool with a plurality of gripper arms, a flat article can also be extracted from a narrow space of a holding apparatus without an articulated connection.

In one embodiment, two adjacent gripper arms simultaneously grip at least two articles in two different adjacent holding apparatuses. Thanks to the gripping tool according to the solution, these two holding apparatuses are unloaded more quickly than if the holding apparatuses were to be emptied consecutively.

According to the solution, all those articles which are located between in each case two adjacent gripper arms of the gripper-arm sequence are removed simultaneously from the respective holding apparatuses. This simultaneous removal is effected by means of a relative movement of the gripper arms relative to those holding apparatuses which are holding the gripped articles and have transported them to the gripping tool. In one embodiment, this relative movement comprises a simultaneous linear movement or another kind of swiveling of all the gripping gripper arms in the same direction away from the holding apparatuses such that the distance of the gripper arms from the holding apparatuses is increased. All the gripper arms are preferably moved over the same distance at the same speed. This embodiment makes it possible to remove the articles without having to change the transport direction of the holding apparatuses. Instead, the articles can be removed while the holding apparatuses are stopped or even being transported further.

The holding apparatuses preferably remain in the sorting installation after the articles have been separated from the holding apparatuses, and are mechanically connected to a guiding device for the holding apparatuses. Each holding apparatus can be used consecutively for transporting a plurality of articles, i.e. is reusable. This embodiment reduces the consumption of materials in comparison to holding apparatuses which are used once only.

In another embodiment, the holding apparatuses are pulled away from the gripper arms e.g. by a linear movement or by a rotation or by a rotation superimposed on a linear movement. All the holding apparatuses are preferably moved in the same direction at the same speed over the same distance. The gripper arms hold articles in or on the holding apparatuses while the holding apparatuses are pulled away from the gripper arms.

In one embodiment, the gripping tool has at least three gripper arms, namely two outer and at least one inner gripper arm. Each two adjacent gripper arms hold at least one article firmly in or on a holding apparatus which is located between them by means of forces acting antiparallel. The same inner gripper arm preferably holds—together with one other gripper arm—two articles simultaneously.

Preferably, at least one inner gripper arm is fixedly mounted on a gripper-arm holder, and two adjacent gripper arms can be moved relative to this inner fixedly-mounted gripper arm. An article in or on a holding apparatus can be gripped in this embodiment in that the distance between two adjacent gripper arms is reduced by a movement transverse to the transport path. Such a movement is preferably a linear movement of this gripper arm toward an adjacent gripper arm. Further movements are not necessary. In particular, it is not necessary to rotate a gripper arm or to fold a gripper arm into itself. This embodiment thus enables simple mechanical implementation.

In another embodiment, the gripper arms are positioned such that at least two articles are located between two adjacent gripper arms. These two articles are preferably located in two different adjacent holding apparatuses. These two adjacent gripper arms exert two forces acting antiparallel on all the articles between these two gripper arms and thereby grip each of these gripped articles directly or indirectly, i.e. at least two articles simultaneously.

In one embodiment, two adjacent gripper arms of the gripper-arm sequence simultaneously grip a plurality of articles which are distributed between at least two holding apparatuses. There are then at least two holding apparatuses located between the gripper arms. The two adjacent gripper arms exert two forces acting antiparallel on each article which is located in one of these holding apparatuses.

All the gripper arms preferably lie in one gripper-arm plane. This gripper-arm plane may be arranged horizontally or else be sloping at an upwardly or downwardly inclined angle.

In one embodiment, each holding apparatus comprises at least one clamp, preferably two clamps. In order to connect an article to be sorted to a holding apparatus temporarily, the clamps of the holding apparatus are opened, the article is put between the jaws of each clamp, and the clamps are closed again or close again by themselves thanks to the force of a spring. For unloading, two gripper arms grip from two sides an article which is hanging on the clamps of a holding apparatus. The clamps are opened once the gripper arms have gripped the article. The gripped article is spatially removed from the holding apparatus.

In another embodiment, each holding apparatus comprises two lateral faces. These lateral faces enclose a space and are mechanically connected to one another. An article to be sorted is put into this enclosed space and is held in this space by the holding apparatus. The lateral faces are preferably arranged parallel to one another, and the holding apparatus is preferably transported such that the lateral faces stand perpendicular to the horizontal or perpendicular to the transport direction.

This embodiment with the lateral faces enables faster loading and unloading of the holding apparatuses than when clamps are used as holding apparatuses and have to be opened, closed and opened again, particularly when articles are to be sorted whose dimensions vary greatly from one another. Two adjacent gripper arms grip an article in the enclosed space in that the gripper arms penetrate the enclosed space from outside and clamp the article in the enclosed space between themselves, thereby gripping the article. It is possible for the two lateral faces to enclose a concave space and/or for the two lateral faces to be fashioned elastically. The two elastic lateral faces hold an article in the enclosed concave space particularly securely.

In one development, the two gripper arms are introduced into the enclosed space from the side, i.e. in a direction parallel to the plane of a lateral face. Or the holding apparatus is moved in a direction which runs parallel to the plane of a lateral face.

In another development of this embodiment, each lateral face which delimits a space for accommodating an article contains a cutout. Viewed in a direction perpendicular to the planes of the lateral faces, a continuous access opening is produced as a result. An article in the enclosed space projects into this access opening. Two adjacent gripper arms grip an article in the enclosed space through the cutouts. In this process, at least one gripper arm is moved toward the access opening in a direction perpendicular to the planes of the lateral faces.

The two cutouts preferably interrupt two opposing edges of the two lateral faces which enclose the space. These edges are preferably vertical, and each cutout begins in such an edge. At these two edges, the two lateral faces are not connected to one another mechanically so a slot or another kind of elongated opening is produced between the two edges. A gripped article can be extracted from the holding apparatus through this opening.

In this embodiment, an article in the enclosed space can be gripped from outside, and the lateral faces nonetheless hold the article securely during transportation. The cutouts can be adjusted in terms of their dimensions and positions to the gripper arms. The embodiment with the cutouts can be combined with an embodiment in which the lateral faces are fashioned elastically and/or are arranged concavely.

In one embodiment, each gripper arm has two gripping surfaces on a holding element and a connecting element which holds the holding element for the gripping surfaces and connects the holding element and thus the gripping surfaces mechanically to a gripper-arm holder of the gripping tool. These connecting elements may be embodied as rod-shaped elements and be narrower than the gripping surfaces of the gripper arms such that each gripper arm has the shape of a spade or spoon. In this way, when a gripper arm is moved, less mass needs to be moved than in the case of rectangular gripper arms, but an equally secure grip is provided. An article is clamped and held temporarily between two opposing gripping surfaces of two adjacent gripper arms.

In a modification, the two outer gripper arms of the gripper-arm sequence each have only one gripping surface which faces inward toward the other gripper arms. Only each inner gripper arm has two gripping surfaces.

The embodiment with the gripping surfaces is preferably combined with an embodiment in which each article to be sorted extends in an article plane and the holding apparatuses hold and transport the articles such that the article planes stand perpendicular to the horizontal and preferably perpendicular to the direction of transport. Each gripping surface extends in a plane which stands perpendicular to the horizontal and preferably perpendicular to the direction of transport. During unloading, the article planes and the gripping-surface planes are disposed parallel to one another.

In one embodiment, the gripping tool is embodied as a stationary device with movable gripper arms. The filled holding apparatuses are transported past the gripper arms, and the gripper arms reach into the transported holding apparatuses. In the region of the removal station, the holding apparatuses are transported relative to the gripping tool in a direction of transport which lies in this gripper-arm plane until the gripper arms are able to grip articles. In another embodiment, the entire gripping tool with the gripper arms is embodied as a movable device and is transported past the holding apparatuses.

In one embodiment, all the gripper arms are located in a gripper-arm plane. The holding apparatuses are or become aligned such that the cutouts in the lateral faces are aligned in a predefined reference plane. The holding apparatuses are preferably aligned before they are transported past the gripping tool or the gripping tool is transported past the holding apparatuses. This reference plane is the same as the gripper-arm plane or parallel to the gripper-arm plane and preferably a horizontal plane e.g. below the holding apparatuses. Aligning the holding apparatuses with a reference plane makes it possible to use different holding apparatuses and to raise or lower individual holding apparatuses such that the different holding apparatuses are aligned when the removal station is reached. In one embodiment, all the cutouts are at an equal distance from the bottom edge of a holding apparatus. The holding apparatuses are then aligned at their bottom edges.

The gripping tool preferably has a gripper-arm swiveling unit. This gripper-arm swiveling unit can swivel gripper arms and in so doing displace them in particular linearly in a direction of displacement and thereby alter the distance between two adjacent gripper arms. The direction of displacement runs preferably parallel to the direction in which the holding apparatuses containing the articles are being moved relative to the gripping tool. Additionally or alternatively, the gripper-arm swiveling unit can rotate the gripper arms individually or all at once about an axis. "Swiveling" is a generic term for a movement which comprises a translational and/or rotational movement component and/or a movement along a closed path, e.g. a circular path.

In one development of this embodiment, the gripper-arm swiveling unit can additionally swivel the gripper arms in another direction. This swiveling, in particular displacing, of the gripper arms causes, when the gripper arms are gripping articles in or on holding apparatuses, the articles to be drawn out of the holding apparatus or holding apparatuses. These holding apparatuses are preferably stopped while the gripper-arm swiveling unit displaces the gripper arms in the other direction. The other direction is preferably perpendicular to the displacing direction.

"Swiveling" in this application and therefore also in this embodiment is a generic term for a movement which comprises a translational or a rotational movement component or both movement components. A linear movement, a rotation about an axis of rotation and a movement along a closed path are special cases of swiveling.

In one embodiment, the articles are singulated, and a flow of articles to be sorted, spaced at intervals from one another, reaches the supply station. In one embodiment, two supply stations operate in parallel, and a flow of articles reaches each supply station. Each supply station puts an article to be sorted into or onto a previously free holding apparatus such that only one article is located in each holding apparatus or the holding apparatus is empty. This embodiment with only one article per holding apparatus makes it easy to sort holding apparatuses with articles according to the measured sort characteristic values and to bring them into a sequence of sorted holding apparatuses.

The invention is described below with reference to an exemplary embodiment, in which:

In the exemplary embodiment, the invention is used for sorting mail items (letters, packages, packets, postcards, etc.) of different dimensions together. Each mail item is furnished with a labeling of a delivery address (name of the recipient and a postal address).

An order of the delivery addresses of these mail items is predefined. This order results e.g. from a predefined path ("delivery sequence") of a mail deliverer ("carrier"). The mail items are intended to be sorted in such a way that after sorting the established sequence of the mail items corresponds to the predefined order of the delivery addresses.

In the exemplary embodiment, the sorting installation can sort various types of mail items. The mail items to be sorted therefore differ from one another in terms of their dimensions (length, height, thickness) and/or their weight and/or their surface characteristics. The various types of mail items are sorted together in a sorting process.

The sorting installation comprises a plurality of holding apparatuses ("holders") in the form of storage pouches ("storage pockets"). Each storage pouch can accommodate at least one mail item and hold it while the storage pouch is being transported. The mail item can subsequently be spatially separated from the holding apparatus again.

In one embodiment, only one type of storage pouch is used, and each storage pouch can accommodate any type of mail item. The storage pouches are thus all homogeneous and have, in particular, the same measurements.

In another embodiment, a plurality of different types of storage pouches, in particular storage pouches having different dimensions, are used. A storage pouch of a first type can accommodate a first type of mail item, a storage pouch of a second type a second type or both types of mail item.

An embodiment is described below in which the sorting installation has two types of storage pouch: tall storage pouches and short storage pouches.

DESCRIPTION OF THE INVENTION

Figure 1:
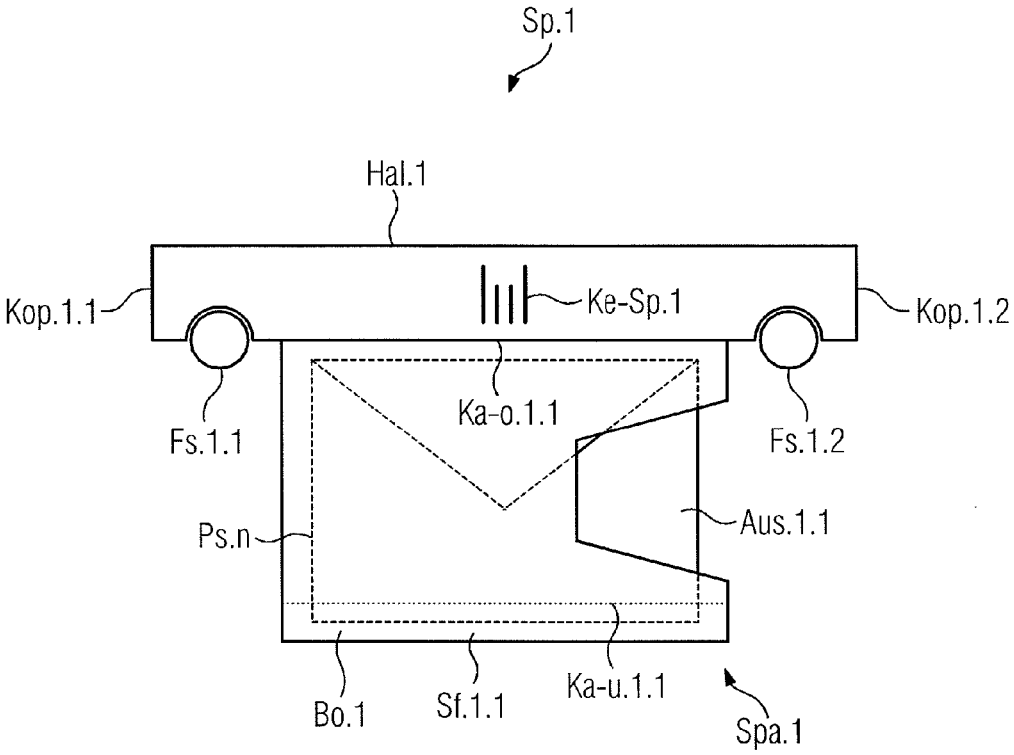
FIG. 1 shows a short storage pouch, from a viewing direction which is perpendicular to the lateral faces.
Figure 2:
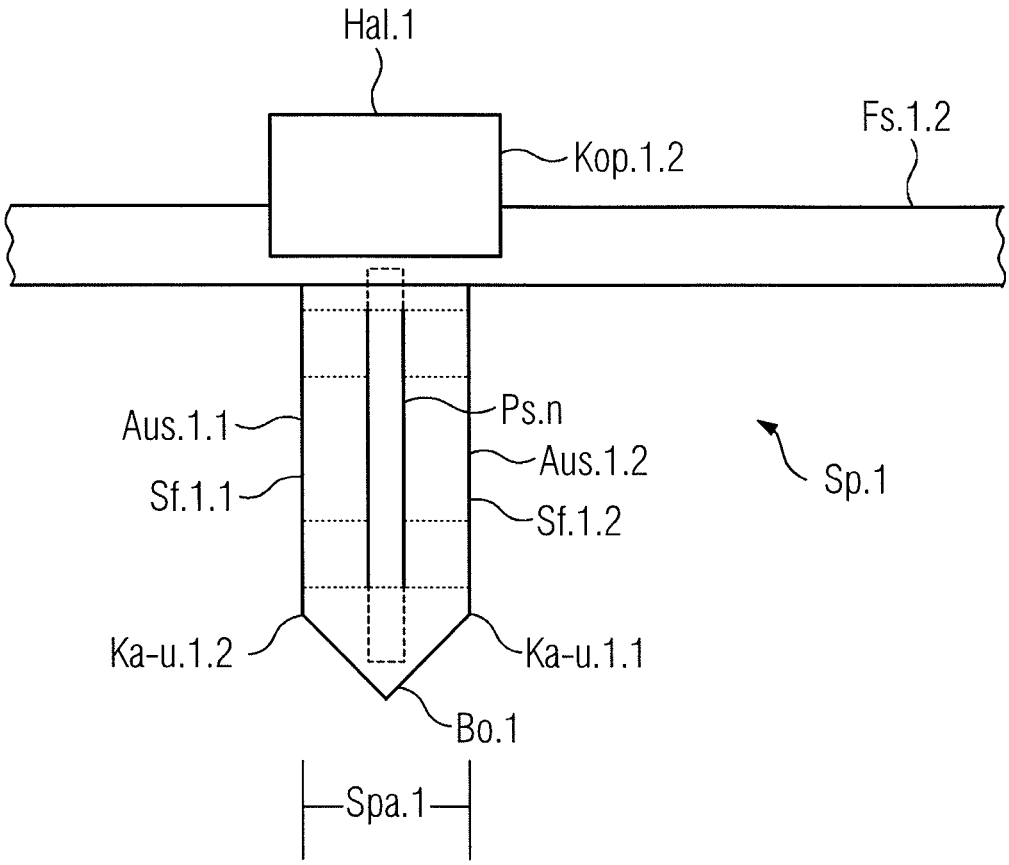
FIG. 2 shows the storage pouch from FIG. 1, viewed from the side.

FIG. 1 and FIG. 2 show by way of example a short storage pouch Sp.1. This storage pouch Sp.1 comprises two rectangular and preferably approximately flat lateral faces Sf.1.1, Sf.1.2, which in use stand approximately perpendicular to the horizontal and perpendicular to the direction of transport and are arranged parallel to one another such that each lateral face St.1.1, Sf.1.2 has a top edge Ka-o.1.1, Ka-o.1.2 and a bottom edge Ka-u.1.1, Ka-u.1.2.

FIG. 1 shows the short storage pouch Sp.1 from a viewing direction that is perpendicular to the lateral faces Sf.1.1, Sf.1.2. FIG. 2 shows this storage pouch Sp.1 from the side. The lateral faces Sf.1.1, Sf.1.2 lie parallel to the drawing plane of FIG. 1 and stand perpendicular to the drawing plane of FIG. 2.

A short mail item Ps.n which is accommodated by the storage pouch Sp.1 is located between these two lateral faces Sf.1.1, Sf.1.2. The two lateral faces Sf.1.1, Sf.1.2 and the base Bo.1 enclose a space for accommodating a flat mail item Ps.n. The two lateral faces Sf.1.1, Sf.1.2 meet in one embodiment at their bottom edges Ka-u.1.1, Ka-u.1.2 and are connected to one another mechanically. This prevents a mail item Ps.n from being able to slide down out of the storage pouch Sp.1. In one embodiment, the two lateral faces Sf.1, Sf.2 are also connected to one another along the entire length of their top edges Ka-o.1.1, Ka-o.1.2. In another embodiment, the two top edges Ka-u.1.1, Ka-u.1.2 are connected to one another only at individual points.

In the example of FIG. 1 and FIG. 2, the two lateral faces Sf.1.1, Sf.1.2 are mechanically connected at their top edges Ka-o.1.1, Ka-o.1.2 to a lateral-face holder Hal.1, and at their bottom edges Ka-u.1.1, Ka-u.1.2 to a base Bo.1. The base Bo.1 has approximately the shape of a V, see FIG. 2. This V-shaped base holds the bottom edge of the mail item Ps.n. The two lateral faces Sf.1.1, Sf.1.2 are thus connected to one another only indirectly.

The two lateral faces Sf.1.1, Sf.1.2 each have two lateral and therefore during operation vertical edges. The lateral faces Sf.1.1, Sf.1.2 are not connected to one another at two adjacent edges, with the result that a slot-shaped opening Spa.1 is produced between these edges. This opening Spa.1 is sufficiently large that a mail item Ps.n. can be pushed by means of a sideward linear movement through the opening Spa.1 into the storage pouch Sp.1 and can also be extracted from the storage pouch Sp.1 again through this opening Spa.1.

In one embodiment, a gripping tool with two gripper arms can grip an article in the storage pouch Sp.1 in that the two gripper arms are inserted through the slot-shaped opening Spa.1 into the space between the two lateral faces Sf.1.1, Sf.1.2 and then grip the article. This requires narrow gripper arms in order to reduce the risk of a gripper arm hitting an article in the storage pouch Sp.1 or against a lateral face Sf.1.1, Sf.1.2.

In the exemplary embodiment, the gripper arms grip an article in the storage pouch Sp.1 in a different manner, namely not through the slot-shaped opening Spa.1 but from the side through cutouts in the lateral faces Sf.1.1, Sf.1.2. The gripper arms may therefore be thicker. Into the two edges of the lateral faces Sf.1.1, Sf.1.2 which delimit this opening Spa.1, one cutout Aus.1.1, Aus.1.2 begins in each lateral face. The cutout Aus.1.1, Aus.1.2 extends into the respective lateral face Sf.1.1, Sf.1.2 and preferably tapers viewed in a direction away from the lateral edge. The cutout has e.g. the shape of a trapezium with rounded corners. A gripping tool with two grippers can grip a mail item which is standing in the storage pouch Sp.1 from both sides through the cutouts Aus.1.1, Aus.1.2 and extract it laterally from the storage pouch Sp.1 without touching a lateral face Sf.1, Sf.2 in the process. The two gripper arms exert two forces acting anti-parallel on the mail items in the holding apparatus.

In the example from FIG. 1, the storage pouch Sp.1 has on the right a vertical opening in the shape of a slot Spa.1, through which a mail item Ps.n, Ps.h can be inserted from the side into the storage pouch Sp.1. The two lateral faces Sf.1.1, Sf.1.2 each contain a cutout Aus.1.1, Aus.1.2 which, viewed in a direction away from the slot-shaped opening Spa.1, tapers. Viewed in a viewing direction perpendicular to the lateral faces Sf.1.1, Sf.1.2, the two cutouts Aus.1.1, Aus.1.2 form a continuous access opening. Two adjacent gripper arms grip through this access opening.

FIG. 2 shows the storage pouch Sp.1 from the side. The lateral faces Sf.1.1, Sf.1.2 stand perpendicular to the drawing plane of FIG. 2. The cutouts Aus.1.1, Aus.1.2 and the slot-shaped opening Spa.1 point toward the viewer. The mail item Ps.n stands on the V-shaped base Bo.1.

Figure 3:
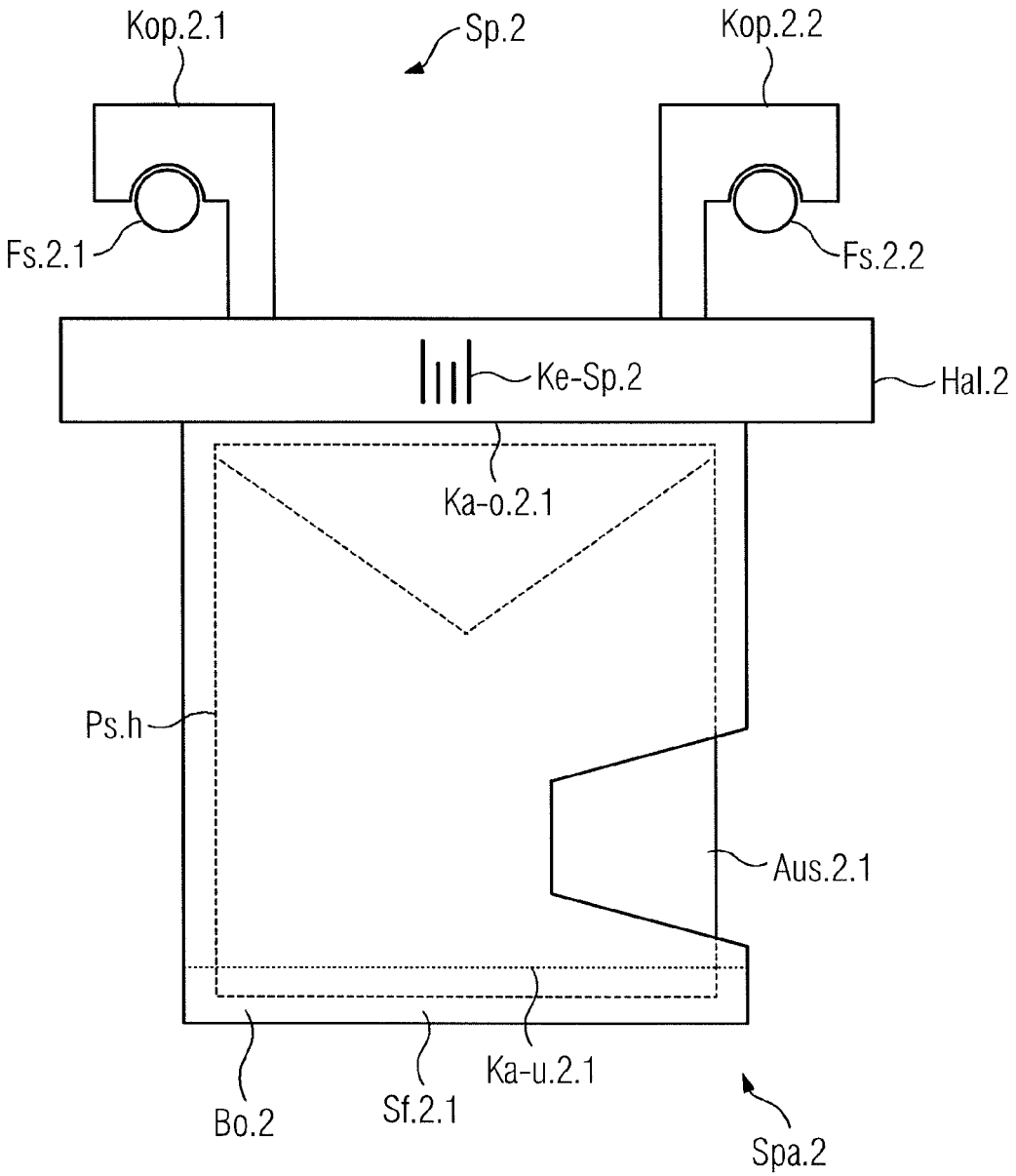
FIG. 3 shows a tall storage pouch, from a viewing direction which is perpendicular to the lateral faces.

FIG. 3 shows a tall storage pouch Sp.2 from the same viewing direction as FIG. 1. The two lateral faces Sf.2.1, Sf.2.2 of the tall storage pouch Sp.2 lie parallel to the drawing plane of FIG. 3. The tall storage pouch Sp.2 accommodates a tall mail item Ps.h. The rear lateral face Sf.2.1 contains a cutout Aus.2.1. The front lateral face Sf.2.2 in FIG. 3 contains a cutout Aus.2.2. The tall storage pouch Sp.2 has a lateral slot-shaped opening Spa.2 and a base Bo.2 in the shape of a V. A mail item Ps.h can be inserted through the slot-shaped opening Spa.2 into the tall storage pouch Sp.2 and removed from the storage pouch Sp.2 again through this opening Spa.2. Just gravity and the V-shaped base Bo.1, Bo.2 hold a mail item Ps.n, Ps.h in the storage pouch Sp.1, Sp.2.

In a deviating embodiment, the tall mail item Ps.h can be inserted between the lateral faces Sf.2.1, Sf.2.2 from above by means of an approximately downwardly directed linear movement. For example, only one lateral face Sf.2.1, Sf.2.2 is connected to the holder Hal.2 such that a horizontal slot-shaped opening is produced next to the holder Hal.2. In this embodiment, also, the tall mail item Ps.h is extracted from the storage pouch Sp.2 again by means of a horizontal linear movement through the lateral slot-shaped opening Spa.2.

In one embodiment, the two lateral faces Sf.1.1 and Sf.1.2 or Sf.2.1 and Sf.2.2 are manufactured from an elastic material. The distance between the top edge Ka-o.1.1 and Ka-o.1.2 or Ka-o.2.1 and Ka-o.2.2 and the bottom edge Ka-u.1.1 and Ka-u.1.2 or Ka-u.2.1 and Ka-u.2.2 of a lateral face Sf.1.1 and Sf.1.2 or Sf.2.1 and Sf.2.2 can be decreased and increased again. In order to insert a mail item Ps.n, Ps.h standing upright into the storage pouch Sp.1, Sp.2, the two lateral faces Sf.1.1 and Sf.1.2 or Sf.2.1 and Sf.2.2 are compressed by a vertical force such that the distance between the top edge and the bottom edge is reduced. As a result, the opening Spa.1, Spa.2 becomes wide enough to insert the mail item Ps.n, Ps.h through the opening Spa.1, Spa.2. Exertion of the vertical force is then terminated, and the elastic lateral faces Sf.1.1 and Sf.1.2 or Sf.2.1 and Sf.2.2 clamp the inserted mail item between them. In this embodiment, the two lateral faces Sf.1.1 and Sf.1.2 or Sf.2.1 and Sf.2.2 thus have—viewed in a direction parallel to the lateral faces—a convex shape.

In another embodiment, the two lateral faces Sf.1.1 and Sf.1.2 or Sf.2.1 and Sf.2.2 have a concave shape at least when a mail item is introduced or extracted, and are mechanically connected to one another at the top and at the bottom respectively by means of a bar or another element, e.g. a holder and a base element. The two lateral faces are preferably fashioned elastically and together have the concave shape at least when no force is acting on the lateral faces. The two parallel bars or other elements are wider than the thickest mail item to be sorted. The empty storage pouch Sp.1, Sp.2 is pulled apart by a vertical force such that the distance between the concave lateral faces Sf.1.1 and Sf.1.2 or Sf.2.1 and Sf.2.2 is large enough even in the center between the two bars to introduce the mail item Ps.n, Ps.h to be transported without the mail item hitting a lateral face. The exertion of the vertical force is terminated as soon as the mail item is inserted. In this embodiment, too, the elastic lateral faces Sf.1.1 and Sf.1.2 or Sf.2.1 and Sf.2.2 clamp the mail item between them as soon as the vertical force is no longer being exerted.

In order to hold the mail item in the storage pouch, no additional force needs to be exerted on the storage pouch from outside. Thanks to the elastic lateral faces, different storage pouches of the same type can hold mail items of differing thicknesses securely. It is not necessary to measure the thickness of a mail item in advance and to make the process of introducing a mail item in a storage pouch dependent on the measured thickness.

In a third embodiment, each lateral face Sf.1.1 and Sf.1.2 or Sf.2.1 and Sf.2.2 consists of two or even three parts, two adjacent parts meeting in a horizontal connecting line. At least two parts of a lateral face Sf.1.1 and Sf.1.2 or Sf.2.1 and Sf.2.2 are connected to one another resiliently. In addition, at least one part of a lateral face is rotatably connected to an adjacent horizontal edge or a base element and also rotatably connected to at least one other part of the lateral face Sf.1.1 and Sf.1.2 or Sf.2.1 and Sf.2.2. A vertical force is again applied in order to alter the storage pouch Sp.1, Sp.2 such that after the alteration a postal item Ps.n, Ps.h can be inserted in a storage pouch Sp.1, Sp.2. This vertical force reduces the distance between the top edge Ka-o.1.1, Ka-o.1.2 or Ka-o.2.1 and Ka-o.2.2 and the bottom edge Ka-u.1.1, Ka-u.1.2 or Ka-u.2.1 and Ka-u.2.2 against the force of the spring elements. The mail item is inserted, and exertion of the vertical force is terminated. The two lateral faces clamp the mail item between them, the springs pressing the lateral faces Sf.1.1 and Sf.1.2 or Sf.2.1 and Sf.2.2 against the mail item Ps.n, Ps.h.

In one embodiment, a mail item Ps.n, Ps.h is in a corresponding manner removed again from the storage pouch Sp.1, Sp.2. A vertical force increases the distance between the two top edges and the two bottom edges in cases where the lateral faces Sf.1.1 and Sf.1.2 or Sf.2.1 and Sf.2.2 are concave or are resiliently connected to one another. In the case of concave lateral faces, the vertical force increases the distance. In all three embodiments, the two lateral faces Sf.1.1 and Sf.1.2 or Sf.2.1 and Sf.2.2 of the storage pouch Sp.1, Sp.2 no longer clamp the mail item between them, and the mail item Ps.n, Ps.h is drawn from the storage pouch Sp.1, Sp.2.

Preferably at least one, in one embodiment even each, storage pouch is furnished with a unique machine-readable identifier, e.g. in the form of a line pattern. This identifier distinguishes this storage pouch from all the other storage pouches of the sorting installation. The short storage pouch Sp.1 has a machine-readable identifier Ke-Sp.1 and the tall storage pouch Sp.2 a machine-readable identifier Ke-Sp.2. These identifiers Ke-Sp.1, Ke-Sp.2 are affixed to the holders Hal.1, Hal.2. A reading device of the sorting installation can decipher the unique identifier on the storage pouch automatically.

The embodiment with the machine-readable identifiers makes it easier to locate a mail item in a storage pouch, even in cases where the lateral face is manufactured from an opaque material. The reading device deciphers the machine-readable identifier on the storage-pouch holder. The information about which mail item is currently located in which storage pouch is stored in a database.

In one embodiment, the storage pouches are transported during sorting at least temporarily along a closed conveyor track, e.g. they are pulled past the supply stations during the supply process. The order of the storage pouches does not change during such transportation because no storage pouch is transferred out of the conveyor track or transferred into the conveyor track and no storage pouch overtakes another storage pouch on the conveyor track. The order of the storage pouches from the conveyor track is known. The transport speed with which the storage pouches are transported along the closed conveyor track is also known or is measured. A storage pouch or individual storage pouches are each furnished with a machine-readable identifier for monitoring whether a storage pouch is actually at the expected location on the conveyor track. The storage pouches are transported past a reading device for machine-readable identifiers.

Each storage pouch Sp.1, Sp.2 has at least one holding element e.g. in the form of a hook and hangs on this holding element. It is also possible for the storage pouch Sp.1, Sp.2 to have two lateral holding elements. Each holding element runs in a guiding device, e.g. along a rail. In the exemplary embodiment, the storage pouches do not have their own drive but are pulled or pushed along the guiding device, e.g. by means of at least one chain.

In the case of two holding elements, all the storage pouches are fashioned in one embodiment such that the distance between the two holding elements of a storage pouch is constantly the same and all the storage pouches can be moved in the same two rails. It is also possible for the storage pouches of a first type to run in a first pair of two guide rails and the storage pouches of a second type to run in a second pair of two guide rails, such that the sorting installation has a total of four guide rails.

In the example from FIG. 1 and FIG. 2, two lateral holding elements Kop.1.1, Kop.1.2, which form a line with the bar-shaped holder Hal.1, are attached to the lateral-face holder Hal.1 of the storage pouch Sp.1 for a short mail item Ps.n. These holding elements Kop.1.1, Kop.1.2 run on a first pair of two parallel guide rails Fs.1.1, Fs.2.2. This embodiment results in a particularly short storage pouch Sp.1.

FIG. 3 shows another embodiment of holding elements. The rod-shaped holder Hal.2 and thus also the lateral faces Sf.2.1, Sf.2.2 of the tall storage pouch Sp.2 hang down on two hook-shaped holding elements Kop.2.1, Kop.2.2. These hook-shaped holding elements Kop.2.1, Kop.2.2 run on a second pair of two guide rails Fs.2.1, Fs.2.2. The distance between the guide rails Fs.2.1, Fs.2.2 of FIG. 3 is less than the distance between the guide rails Fs.1.1, Fs.1.2 of FIG. 1. The tall storage pouch Sp.2 is, however, exactly as wide as the short storage pouch Sp.1.

Each supply station Bel.n, Bel.h selects a storage pouch that is suitable and still free for an incoming mail item. The supply station Bel.n selects a short storage pouch Sp.1, the supply station Bel.h a free tall storage pouch Sp.2. Tall and short storage pouches are transported in arbitrary order past the supply stations Bel.n, Bel.h.

A sorting and transporting device Sort transports and sorts the filled storage pouches. The sorting and transporting device Sort changes the order of the filled storage pouches e.g. by transferring a filled storage pouch out of the closed conveyor track and moving it into an intermediate store, the sorting and transporting device Sort having a plurality of intermediate stores. Storage pouches from intermediate stores are transferred into the closed conveyor track again, the order of the storage pouches changing as a result. It is also possible for the storage pouches from the intermediate stores to be transferred into a further conveyor track and for the desired order of the storage pouches to be established there.

Figure 4:
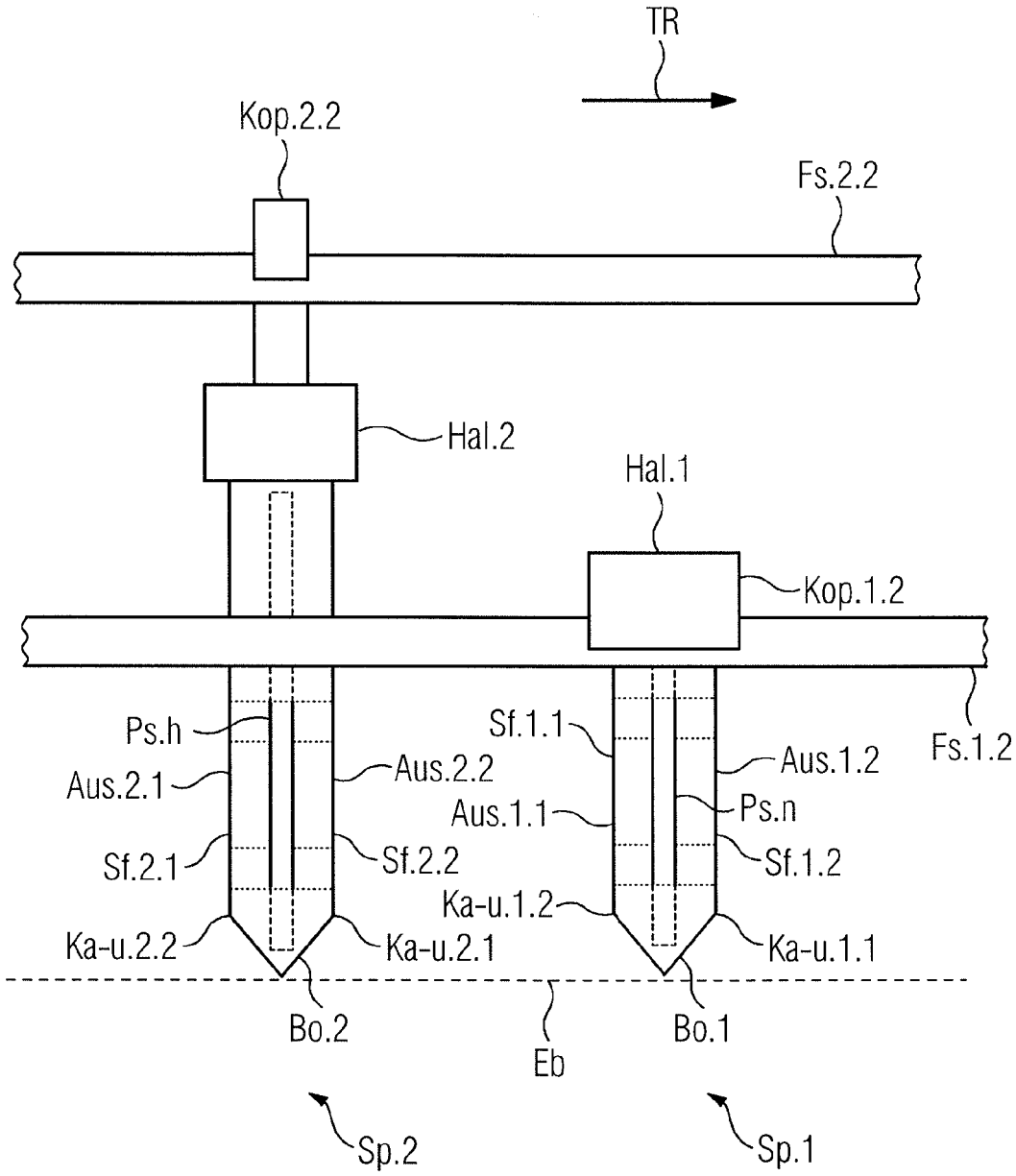
FIG. 4 shows the storage pouches from FIG. 1 and FIG. 3, viewed from the side and simultaneously hanging on guide rails.

FIG. 4 illustrates an embodiment of how the sorting and transporting device Sort can transport both tall and short storage pouches in a single sequence, the tall storage pouches and the short storage pouches being mixed arbitrarily. In FIG. 4, two right-hand guide rails Fs.1.2 and Fs.2.2 can be seen. The tall storage pouch Sp.2 runs with its holding elements Kop.2.1, Kop.2.2 in the two top guide rails Fs.2.1, Fs.2.2. The short storage pouch Sp.1 runs with its holding elements Kop.1.1, Kop.1.2 in the two bottom guide rails Fs.1.1, Fs.1.2. The top guide rails Fs.2.1, Fs.2.2 are at a shorter distance from one another than the bottom guide rails Fs.1.1, Fs.1.2. The four guide rails Fs.1.1, Fs.1.2, Fs.2.1, Fs.2.2 are arranged such that the bottom edges of the bases Bo.1, Bo.2 of the two storage pouches Sp.1, Sp.2 lie in an imaginary horizontal plane Eb. As a result, the mail items in the storage pouches Sp.1, Sp.2 are aligned due to gravity with their bottom edges approximately on this plane Eb. The distances of the cutouts Aus.1.1, Aus.1.2, Aus.2.1, Aus.2.2 from this horizontal plane Eb are equal. This makes it easier for the gripping tool according to the solution to remove a plurality of mail items from storage pockets of differing heights simultaneously.

Figure 5:
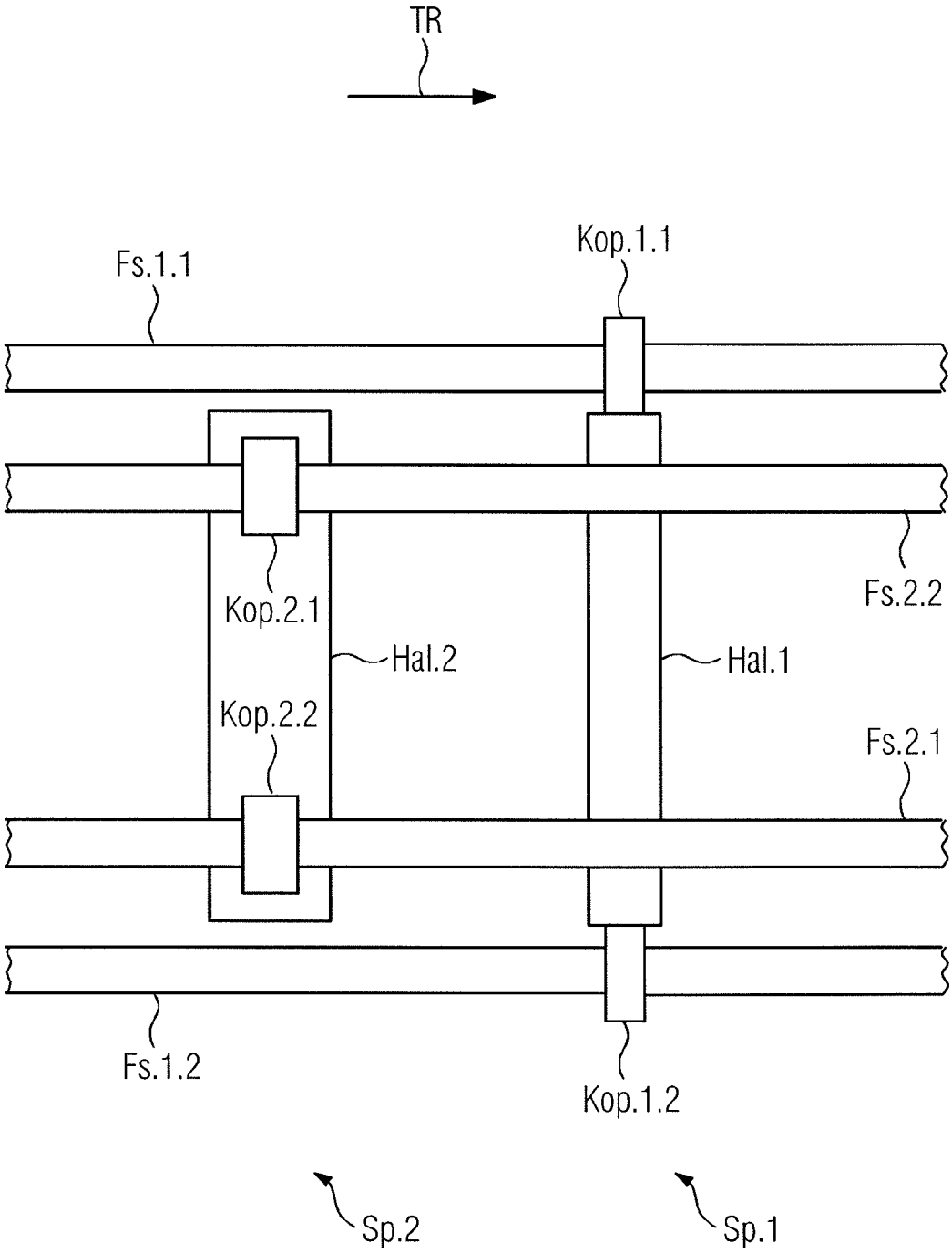
FIG. 5 shows the two storage pouches from FIG. 4 on a total of four guide rails, viewed from above.

FIG. 5 shows the arrangement of FIG. 4 from above. The top guide rails Fs.2.1, Fs.2.2 on which the holding elements Kop.2.1, Kop.2.2 of the tall storage pouch Sp.2 are hanging can be seen. The bottom guide rails Fs.1.1, Fs.1.2 on which the holding elements Kop.1.1, Kop.1.2 of the short storage pouch Sp.1 are hanging can also be seen. The short storage pouch Sp.1 is located entirely below the guide rails Fs.2.1, Fs.2.2 for the tall storage pouch Sp.2.

In one embodiment, holding apparatuses with clamps are used instead of storage pouches for transporting and sorting mail items. Each holding apparatus comprises a horizontal bar on which at least one clamp and at least one holding element are mounted. The holding element runs exactly as in the case of the storage pouches in a guiding device and holds the clamps. Two holding elements may also be mounted laterally on the bar. The holding apparatus holds a mail item in a vertical position by means of the at least one clamp, preferably by means of two clamps, in approximately the same way as a trouser hanger holds trousers. The clamps can be opened in a controlled manner, and the mail item slides downward due to gravity.

It is also possible for the sorting installation to have both a plurality of storage pouches and a plurality of holding apparatuses with clamps and for these two types of holding apparatuses to be used in parallel.

The sorting installation also has the following components:

at least one feeder with a singulator, preferably one feeder for each type of mail item, an imaging device, an image analysis unit, at least one supply station in the form of a loading station, a sorter for filled holding apparatuses, at least one removal station in the form of an unloading station with the gripping tool according to the solution, at least one receiving station for mail items which have been removed again from their holding apparatuses, and a mail-item data store containing one data set per mail item.

Figure 6:
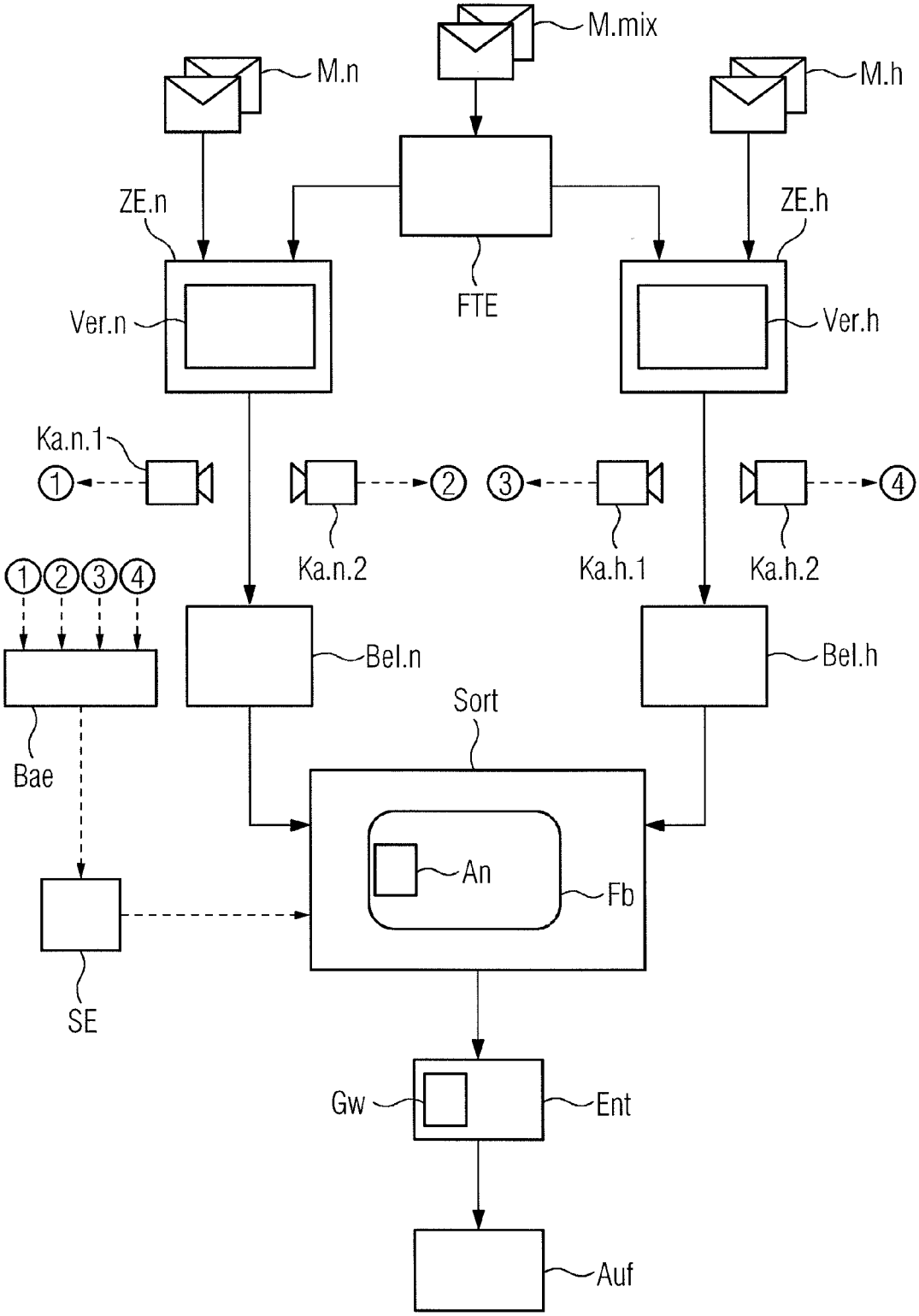
FIG. 6 shows schematically the sorting installation with the gripping tool according to the solution.

FIG. 6 shows schematically the components of the sorting installation of the exemplary embodiment. Material flows are represented by solid lines and data flows by dashed lines. The following components are shown:

a format-separating device FTE, two feeders ZE.n, ZE.h operating in parallel, each comprising a singulator Ver.n, Ver.h, an imaging device for short mail items in the form of two opposing cameras Ka.n.1, Ka.u.2, which generate computer-accessible images of short mail items, an imaging device for tall mail items in the form of two opposing cameras Ka.h.1, Ka.h.2, which generate computer-accessible images of tall mail items, an image analysis unit Bae which analyzes computer-accessible images of mail items, a loading station Bel.n which fills storage pouches with short mail items, a further loading station Bel.h which fills storage pouches with tall mail items, a sorter Sort for filled holding apparatuses, the sorter Sort comprising a closed conveyor track Fb and a drive An for the driveless holding apparatuses on this closed conveyor track Fb, an unloading station Ent comprising a gripping tool Gw according to the solution which removes both short and tall mail items from storage pouches, a receiving station Auf which receives removed mail items, a mail-item data store Dsp and a control unit ("controller") SE.

In one embodiment, each holding apparatus has its own drive. This drive rotates a roller which touches a guide rail and when rotated moves the holding apparatus along this guide rail.

In another embodiment, the sorter Sort has at least one stationary drive An and for each drive a transmission means, e.g. a chain. The driven transmission means moves the holding apparatuses along the guiding device and as a result along the conveyor track Fb. For example, the drive An pulls on the chain, and the chain pulls the holding apparatuses St.1, St.2 along the guide rails Fs.1.1, Fs.1.2, Fs.2.1, Fs.2.2.

A set M.n. of short mail items, in particular standard letters, is transported to the feeder ZE.n with the singulator Ver.n. The singulator Ver.n can singulate these short mail items. A set M.h. of tall mail items, in particular large letters, is transported to the feeder ZE.h with the singulator Ver.h. The singulator Ver.h can singulate these tall mail items. The two feeders ZE.n, ZE.h operate in parallel. In one embodiment, the singulator Ver.n for standard letters operates with a significantly higher throughput than the singulator Ver.h for large letters, and significantly more standard letters than large letters reach the format-separating device FTE.

In addition, a set M.mix of mail items consisting of a mixture of large letters and standard letters is transported to the format-separating device FTE. The format-separating device FTE divides the mail items of the set M.mix into a set containing standard letters and a set containing large letters.

In each case, a set comprising mail items of one type reaches the suitable feeder ZE.n, ZE.h.

In another embodiment, the two singulators Ver.n, Ver.h can singulate all machine-processable mail items. In the case of a plurality of identical feeders operating in parallel ZE.n, ZE.h, the incoming mail items are distributed such that the feeders are utilized as evenly as possible. Each singulator Ver.n, Ver.h singulates in both embodiments the mail items fed to it and generates a flow of mail items which are transported further, spaced at a distance from one another and standing upright.

For each mail item, the following steps are executed after singulation:

The mail item is transported in an upright position between the two cameras Ka.n.1, Ka.n.2 if the mail item is a short mail item.

The mail item is transported between the two cameras Ka.h.1, Ka.h.2 if the mail item is a tall mail item.

The two cameras Ka.n.1, Ka.n.2 and Ka.h.1, Ka.h.2 each generate at least one computer-accessible image of a surface of the mail item. One of these two images shows the delivery address label—unless the mail item has no delivery address label.

The image analysis unit Bae attempts automatically by means of optical character recognition (OCR) to uniquely decipher the delivery address label in the image. To do this, the image analysis unit Bae preferably accesses a database containing valid delivery address labels ("dictionary"). If this does not succeed, then the image is displayed on a display screen device of a video coding station, and an operator enters a part of the delivery address via keyboard and/or via voice input.

A data set is generated for the mail items automatically. This data set comprises an internal identifier for the mail item and a coding of the deciphered delivery address label.

This data set is stored in the central mail-item data store DSp.

In one embodiment, the mail item is measured in order to establish which type of storage pouch can accommodate this mail item. An image is preferably analyzed in order to measure the length and the height of the mail item. If there are different loading stations, it is additionally established which loading station can currently put this mail item into a storage pouch.

The mail item is aligned on its bottom edge and transported to a suitable and available loading station Bel. n, Bel.h. Preferably, the upright mail item is temporarily clamped between two endless conveyor belts. The endless conveyor belts rotate with equal speed and transport the mail item as a result.

If there are different types of holding apparatuses, then the loading station Bel.n, Bel.h selects a suitable empty holding apparatus for the mail item.

The loading station Bel.n, Bel.h pushes the mail item by means of an approximately linear movement into a previously empty storage pouch or temporarily connects the mail item to a holding apparatus with clamps. In the exemplary embodiment, the linear movement is approximately horizontal if the mail item is a short mail item. In the case of a tall mail item, the movement is an approximately vertically downwardly directed movement.

A bar code reader ("bar code scanner") or another suitable reading device reads the unique identifier of this storage pouch or other holding apparatus. The data set for the mail item in the mail item data store DSp is supplemented with a coding of this read identifier of the holding apparatus so that the information as to which holding apparatus the mail item is now located in is available. From this it can be determined where the mail item is located in the sorting installation. In addition, the delivery address label of the mail item in a holding apparatus specifies the target position of this filled holding apparatus in the sequence of holding apparatuses to be created.

The holding apparatus with the mail item is transported as far as an unloading station Ent. The unloading station Ent extracts the mail item from the holding apparatus again.

The removed mail item is transported to the receiving station Auf.

The receiving station Auf receives the removed mail items. For example, a container that is open at the top stands on a supporting surface of the receiving station Auf, and the removed mail items are laid or placed in the container. This step can be executed by the gripping tool Gw, an automatic handling machine or else an operator.

The sorter Sort establishes an order of the filled holding apparatuses. This order of the holding apparatuses is predefined by the respective delivery address labels on the mail items in the holding apparatuses and by the predefined order of the delivery addresses. After sorting, the mail items are brought into the desired order, but are still located in the holding apparatuses.

It will be described below how the unloading station Ent extracts using a gripping tool Gw a plurality of mail items from their holding apparatuses at once. The embodiment in which storage pouches are used as holding apparatuses will be described first.

The unloading station comprises the gripping tool Gw. This gripping tool Gw comprises:

two outer gripper arms, in the exemplary embodiment, N≥1 inner gripper arms, a gripper-arm holder for the total of N+2 gripper arms, a swiveling unit for the gripper arms, a swiveling unit for the gripper-arm holder.

Figure 7:
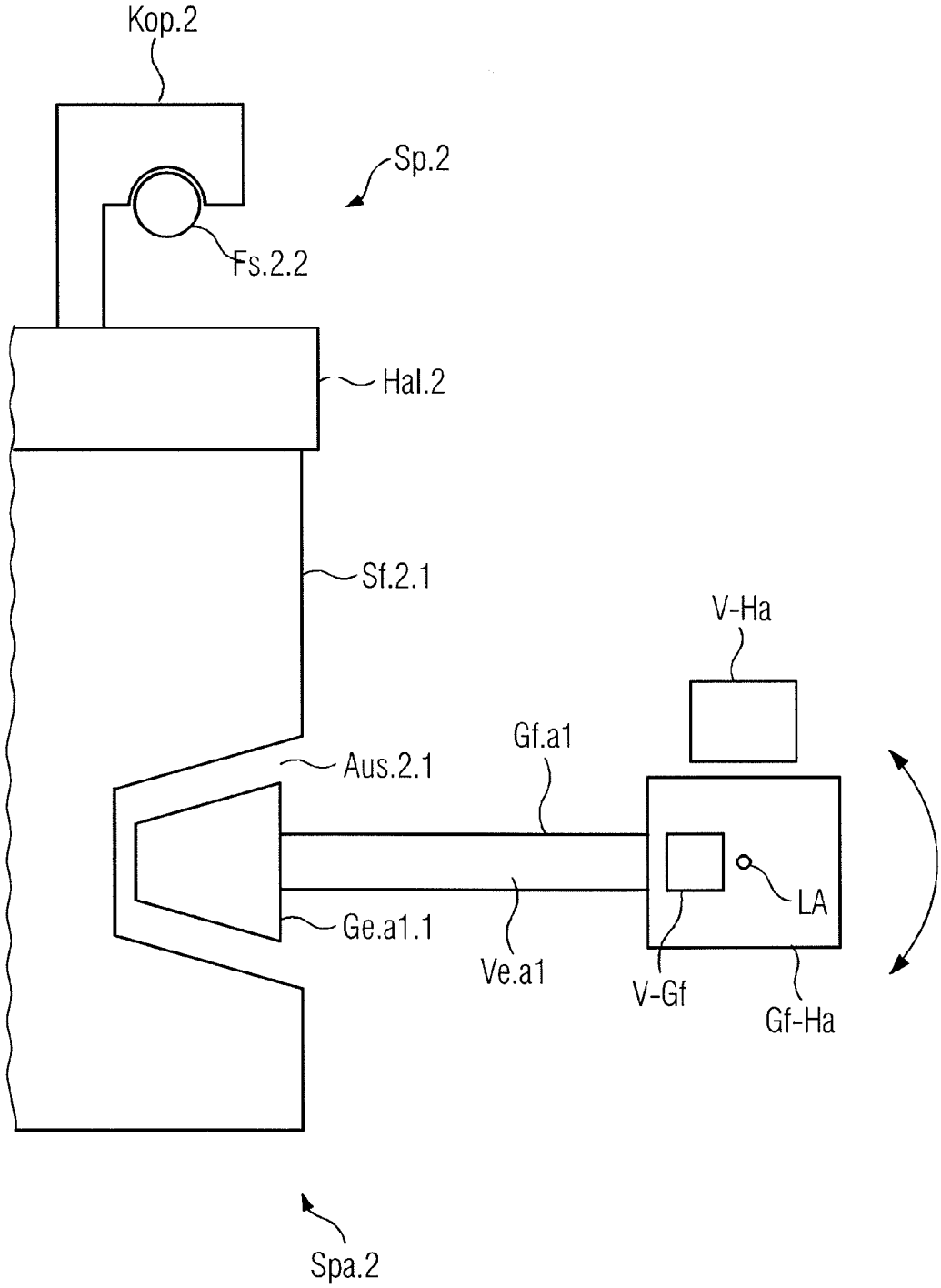
FIG. 7 shows the gripping tool of the removal station and a storage pouch containing a cutout, from the side.
Figure 8:
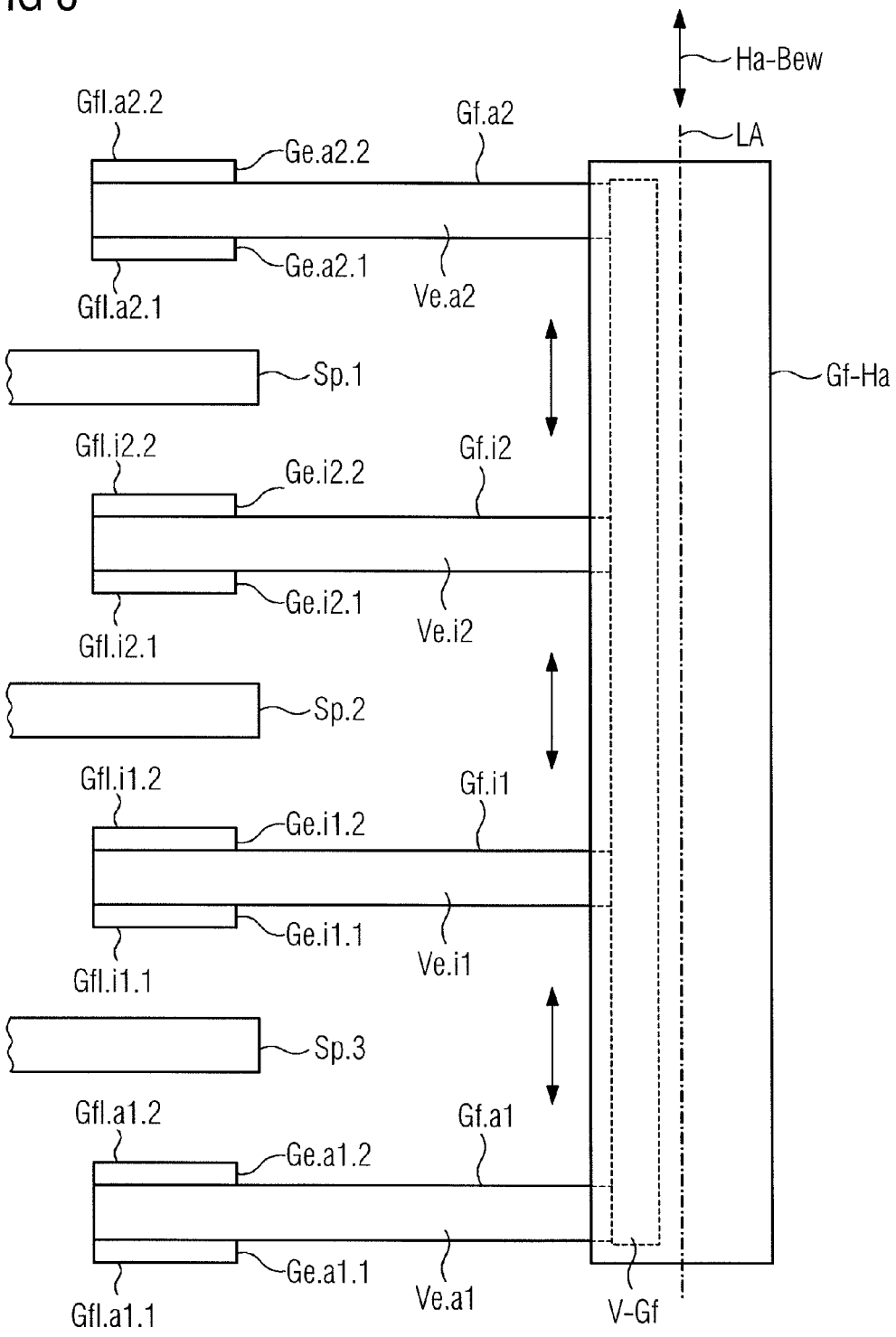
FIG. 8 shows the gripping tool from FIG. 7 and three storage pouches, from above.

FIG. 7 and FIG. 8 show by way of example a gripping tool Gw comprising two outer gripper arms Gf.a1, Gf.a2 and N=2 inner gripper arms Gf.i1 and Gf.i2. The four gripper arms Gf.a1, Gf.a2, Gf.i1, Gf.i2 sit on the gripper-arm holder Gf-Ha. Also shown are a holder swiveling unit V-Ha and a gripper-arm swiveling unit V-Gf.

FIG. 7 also shows a tall storage pouch Sp.2 to be unloaded. The lateral faces Sf.2.1, Sf.2.2 thereof lie parallel to the drawing plane of FIG. 7. In the plan view of FIG. 8, three storage pouches to be unloaded Sp.1, Sp.2, Sp.3 are shown whose lateral faces stand perpendicular to the drawing plane of FIG. 8.

The gripper-arm holder Gf-Ha extends along a longitudinal axis LA. The N+2 gripper arms Gf.a1, Gf.a2, Gf.i1, Gf.i2 are movably connected to this gripper-arm holder Gf-Ha, and are connected in such a way that the gripper arms are arranged in a gripper-arm sequence along this longitudinal axis LA in a fork-like or comb-like manner. The longitudinal axis LA may be arranged horizontally or else at a downwardly or upwardly inclined angle. The N+2 gripper arms Gf.a1, Gf.a2, Gf.i1, Gf.i2 are movably connected to the gripper-arm holder Gf-Ha such that the distance between two adjacent gripper arms can be altered. The longitudinal axis LA of the gripper-arm holder Gf-Ha stands perpendicular to the drawing plane of FIG. 7 and lies in the drawing plane of FIG. 8. In FIG. 7, only an outer gripper arm Gf.a1 can be seen.

The gripper-arm swiveling unit V-Gf can, by means of its own drive, alter the distance in each case between two adjacent gripper arms, e.g. by means of linear movements. In one embodiment, the gripper-arm swiveling unit V-Gf can alter all the distances between adjacent gripper arms in a synchronized manner, e.g. such that two adjacent gripper arms constantly have the same distance. In another embodiment, the gripper-arm swiveling unit V-Gf can alter each distance between two adjacent gripper arms separately. For example, the gripper-arm holder Gf-Ha is telescopically structured and can be pushed together and pulled apart again.

In the example of FIG. 7 and FIG. 8, the gripper-arm swiveling unit V-Gf is set into the gripper-arm holder Gf-Ha. Each gripper arm Gf.a1, Gf.a2, Gf.i1, Gf.i2 is connected mechanically to this gripper-arm swiveling unit V-Gf.

The holder swiveling unit V-Ha can swivel the gripper-arm holder Gf-Ha with the N+2 gripper arms. "Swiveling" signifies a linear movement and/or a rotational or translational rotation. In one embodiment, it can displace the gripper-arm holder Gf-Ha in a linear manner, e.g. in a horizontal direction, and thereby perpendicularly to the longitudinal axis LA of the gripper-arm holder Gf-Ha. In another embodiment, it can rotate the gripper-arm holder Gf-Ha about the longitudinal axis LA. The holder swiveling unit V-Ha can in one embodiment also displace the gripper-arm holder Gf-Ha parallel to the longitudinal axis LA. Combinations of these embodiments are possible.

In one embodiment, the holder swiveling unit V-Ha can, in addition, move the gripper-arm holder Gf-Ha in a linear manner or otherwise swivel it in a direction which lies in the drawing plane of FIG. 7. By means of this movement, the distance between the gripper-arm holder Gf-Ha and the storage pouches alters, as a result of which the gripped mail items can be drawn from the storage pouches.

In the example of FIG. 7 and FIG. 8, the holder swiveling unit V-Ha acts mechanically on the gripper-arm holder Gf-Ha and can rotate the gripper-arm holder Gf-Ha about the longitudinal axis LA, cf. the curved double arrow in FIG. 7. The holder swiveling unit V-Ha can also displace the gripper-arm holder Gf-Ha together with the gripper arms Gf.a1, Gf.a2, Gf.i1, Gf.i2 and the gripper-arm swiveling unit V-Gf parallel to the longitudinal axis LA, and can do so in both directions, cf. the double arrow in FIG. 8.

In the embodiment shown in FIG. 7, the holder swiveling unit V-Ha is arranged outside the gripper-arm holder Gf-Ha and acts from outside on the gripper-arm holder Gf-Ha. It is also possible for the gripper-arm holder Gf-Ha to comprise housing, and for the holder swiveling unit V-Ha also to be arranged in this housing.

FIG. 8 shows a continuous gripper-arm holder Gf-Ha which carries four gripper arms. It is also possible for the apparatus to have at least two gripper-arm holders which each carry a part of the gripper arms. All the gripper-arm holders are preferably rotatable about the same longitudinal axis LA. A gripper-arm holder can also be displaced in the direction of the rotational axis LA relative to another gripper-arm holder, as a result of which the distance between two adjacent gripper arms on different gripper-arm holders is altered.

Each gripper arm Gf.a1, Gf.a2, Gf.i1, Gf.i2 has a gripping element with at least one gripping surface. This gripping surface is fashioned preferably from an elastic material having a high coefficient of friction, e.g. from rubber. The elastic gripping surface may be mounted on a solid body of the gripping element. A gripping element in one piece is also possible. In one embodiment, this gripping element is connected by means of a connecting element, e.g. by means of a rod, to the holder.

In one embodiment, a gripping surface contains cutouts. The gripper arm is fashioned with a hollow interior. A suction apparatus generates a negative pressure in this cavity in the gripper arm. Through the cutouts, this negative pressure acts upon a mail item and sucks the mail item onto the gripper arms. In this way, even a mail item with a very smooth surface is gripped securely.

In the example of FIG. 7 and FIG. 8, the outer gripper arm Gf.a1 has the two gripping elements Ge.a1.1 and Ge.a1.2 which are both attached to the connecting element Ve.a1. Seen in a viewing direction parallel to the longitudinal axis LA, each gripper arm has in this embodiment the shape of a spoon or spade with the connecting element as a shaft. Correspondingly, the inner gripper arm Gf.i1 has the two gripping elements Ge.i1.1 and Ge.i1.2. The same applies to the other gripper arms Gf.a2, Gf.i2.

In one embodiment, a gripper arm—or at least the connecting element of a gripper arm—is fashioned flexibly elastically. The distance between two adjacent gripper arms may therefore vary over the length of the gripper arms, i.e. perpendicular to the drawing plane of FIG. 7, particularly when the adjacent gripper arms are gripping articles. This embodiment makes it possible for two adjacent gripper arms to clamp a mail item or else a plurality of mail items between them and for the restoring force of the deflected elastic gripper arms also to hold the gripped mail items.

In one embodiment, the connecting element Ve.a1, Ve.a2, Ve.i1, Ve.i2 is fashioned telescopically. The gripper-arm swiveling unit V-Gf can alter the length of the connecting element Ve.a1, Ve.a2, Ve.i1, Ve.i2 and thereby increase and decrease the distance between the gripper-arm holder Gf-Ha and the gripping element. In another embodiment, the connecting element Ve.a1, Ve.a2, Ve.i1, Ve.i2 is fashioned rigidly. In a preferred embodiment, the gripping element of each inner gripper arm Gf.i1, Gf.i2 has two gripping surfaces, which are attached to the two sides of the gripping element. The gripping element Ge.i1.1 has the gripping surface Gf1.*i*1.1, the gripping element Ge.i1.2 has the gripping surface Gf1.*i*1.2, and so on. Each gripping surface of this inner gripper arm faces the gripping surface of an adjacent gripper arm. All the gripping surfaces are preferably equal in size and have identical dimensions. It is possible for a gripping surface to consist of a plurality of gripping-surface components which are spaced at a distance from one another.

A mail item can be clamped and held between these two opposing gripping surfaces. The two outer gripper arms need only one gripping element Ge.a1.2, Ge.a2.1 and therefore only one gripping surface Gf1.*a*1.2, Gf1.*a*2.1. It is however possible for all the gripper arms Gf.a1, Gf.a2, Gf.i1, Gf.i2 to be identical in structure and for the two outer gripper arms therefore also to have two gripper-arm gripping surfaces each. This case in shown in FIG. 8.

Because the gripping tool Gw has a total of N inner gripper arms, each having two gripping elements and therefore two gripping surfaces, and two outer gripper arms, each having at least one gripping surface, N+1 pairs of opposing gripping surfaces are formed such that the gripping tool Gw can simultaneously grip between each two gripping surfaces a total of N+1 mail items.

In the example of FIG. 8, N+1=3 pairs of opposing gripping surfaces are formed. These three pairs can simultaneously draw at least three mail items from three storage pouches Sp.1, Sp.2, Sp.3.

An embodiment with only one gripping surface per gripper arm is also possible. In this embodiment, too, two gripping surfaces face one another in each case. In this embodiment N must be even, and the gripping tool can simultaneously grip N/2+1 mail items simultaneously.

As set out above, each lateral face Sf.1.1, Sf.1.2, Sf.2.1, Sf.2.2 of each storage pouch Sp.1, Sp.2 has one cutout Aus.1.1, Aus.1.2, Aus.2.1, Aus.2.2, respectively. The two cutouts are equal in size and congruent or have at least a common cutout area as an access opening that is larger than each gripper surface—seen in a viewing direction perpendicular to the lateral faces Sf.1.1, Sf.1.2, Sf.2.1, Sf.2.2. In this way it is possible for two adjacent gripping surfaces to grip a mail item in the storage pouch from outside through the two cutouts without touching the two lateral faces. This makes it possible for a mail item to be drawn from a storage pouch in that the storage pouch is pulled away from the gripping tool Gw or the gripping tool Gw draws the mail item from the storage pouch that is held or continues to be moved along the guide rails.

If holding apparatuses with clamps are used, then two adjacent gripping surfaces can grip a mail item freely because the mail item hangs on the clamps.

In a previously described embodiment, only one holding apparatus with a mail item is located in each case between two adjacent gripper arms. In a modification, a plurality of holding apparatuses with mail items are located between two adjacent storage pouches. In the simplest embodiment of this modification, the gripper tool has only two gripper arms Gf.a.1 and Gf.a.2, but no inner gripper arm. In this embodiment, all three storage pouches Sp.1, Sp.2, Sp.3 of FIG. 8 are located between these two outer gripper arms Gf.a.1, Gf.a.2. The distance between the two gripper arms Gf.a.1, Gf.a.2 is reduced, and the gripper arms grip all three mail items in the storage pouches Sp.1, Sp.2, Sp.3 simultaneously. The mail item in the inner storage pouch Sp.2 is gripped indirectly, the two gripper arms Gf.a.1, Gf.a.2 pressing the two mail items in the outer storage pouches Sp.1, Sp.3 against the mail item in the inner storage pouch Sp.2. In this embodiment, the two lateral faces of the inner storage pouch Sp.2 and one lateral face of each of the outer storage pouches Sp.1, Sp.3 are pressed together.

In one embodiment, all the cutouts of the storage pouches are at the same distance from the top edge of the storage pouches. As a result, all the storage pouches are automatically positioned such that the gripping tool Gw can remove the mail items because the storage pouches hang by means of the holding elements on the guiding device. This guiding device follows a horizontal course in the region of the unloading station. The distance of a cutout from the bottom edge of a storage pouch may vary from storage pouch to storage pouch.

In another embodiment, there are two types of storage pouch with two different distances between the two cutouts and the bottom edge. In this embodiment, the guiding device has two sections lying above one another in the region of the unloading station. A filled storage pouch is directed onto the upper section if the storage pouch has a larger distance, and otherwise onto the lower section. As a result, all the cutouts are located on the same level in the region of the unloading station. The upper section comprises e.g. a pair of upper guide rails, the lower section a pair of lower guide rails.

Figure 9:
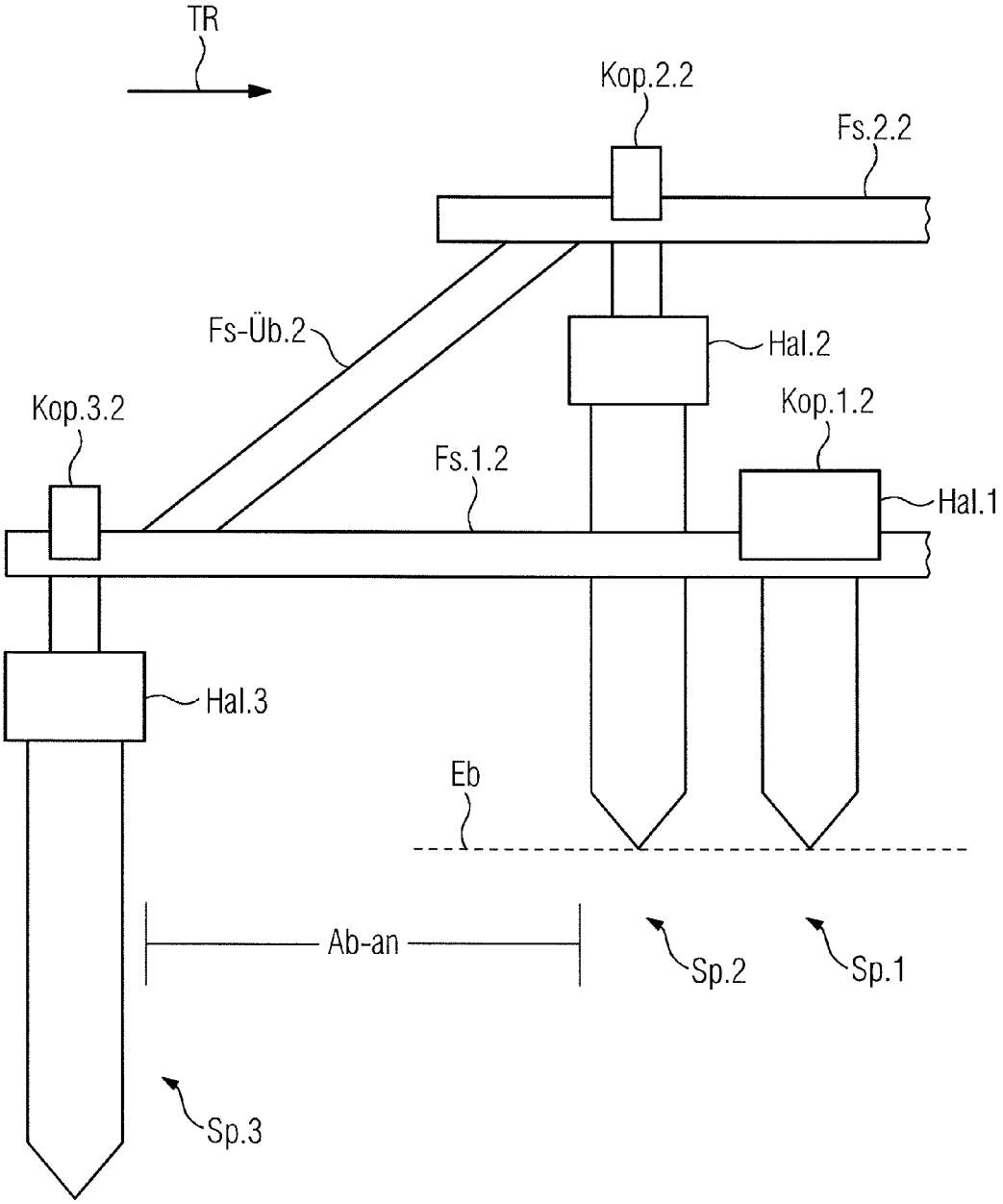
FIG. 9 shows an embodiment of the guiding device which brings storage pouches to the same level.

FIG. 9 shows this embodiment schematically. Outside the unloading station Ent, the two guide rails Fs.1.1, Fs.1.2 for short storage pouches and the two guide rails Fs.2.1, Fs.2.2 for tall storage pouches are brought to the same level and lie in a horizontal plane. The cutouts are therefore still at different levels. In the region of the unloading station Ent, the guide rails for the tall storage pouches have two inclined transition sections, i.e. viewed in the direction of transport firstly a rising section and then a falling section. It is also possible for the rising section to be arranged downstream of the falling section.

The direction of transport TR of the storage pouches Sp.1, Sp.2, Sp.3 is illustrated in FIG. 9. The right-hand guide rail Fs-Üb.2 of a rising section Ab-an is shown. The tall storage pouch Sp.3 is still located in front of this rising section Ab-an, the tall storage pouch Sp.2 has already passed through the rising section Ab-an. The bottom edges of the short storage pouch Sp.1 and of the tall storage pouch Sp.2 are aligned with the reference level Eb, which in turn is caused by the different heights of the guide rails Fs.1.1 and Fs.1.2 on the one hand, and Fs.2.1 and Fs.2.2 on the other. As a result, the cutouts Aus.1.1, Aus.1.2, Aus.2.1, Aus.2.2 in the lateral faces Sf.1.1, Sf.1.2, Sf.2.1, Sf.2.2 are also aligned.

In the exemplary embodiment, a sequence is selected containing a maximum of N+1 or N/2+1 mail items which follow one another directly in the established sequence of filled storage pouches, once this sequence has been established by sorting the filled storage pouches. These mail items in the sequence are intended to be extracted in a single removal process and practically simultaneously from their N+1 storage pouches (one gripper arm with two gripping surfaces between two adjacent storage pouches) or N/2+1 storage pouches (two gripper arms with one gripping surface each between two adjacent storage pouches).

The storage pouches with the selected sequence are transported to a position in which the gripping tool Gw can grip all the mail items of the sequence located in the storage pouches at once. In one embodiment, it suffices for the storage pouches to be transported along the guiding device and then halted when the sequence has reached the shortest distance from the gripper arms of the gripping tool Gw. The storage pouches are arranged and transported such that the lateral faces stand perpendicular to the direction of transport.

The gripper-arm swiveling unit V-Gf establishes in one embodiment a distance between each two adjacent gripper arms such that this distance is greater than a filled storage pouch is thick. The holder swiveling unit V-Ha rotates and/or pushes the N+2 gripper arms between the maximally N+1 storage pouches of the selected N+1 mail items. If M<N+1 mail items have been selected, then N+1 gripper arms, including preferably one outer gripper arm, are swiveled between the corresponding M+1 storage pouches. The other N-M gripper arms are swiveled to a position outside the storage pouches.

In another embodiment, the gripper arms Gf.a1, Gf.a2, Gf.i1, Gf.i2 can be displaced even without a drive along the longitudinal axis LA of the gripper-arm holder Gf-Ha. During swiveling and on account of being swiveled into a position between the storage pouches, the gripper arms are pushed as far apart as is necessary. For example, each storage pouch has a bar on top with a type of saddle roof which can displace a gripper arm laterally when lowered.

In a preferred embodiment, the gripper arms are firstly rotated about the axis of rotation LA to the extent that the storage pouches can be displaced parallel to the longitudinal axis LA and parallel to the guide rails Fs.1.1, Fs.1.2, . . . without hitting against a gripper arm. In the example of FIG. 7, this is achieved by rotating the gripper-arm holder Gf-Ha clockwise about the longitudinal axis LA. The storage pouches containing the mail items are advanced to a position obliquely below the rotated gripper arms and then halted. The gripper arms are rotated backward, i.e. in the example of FIG. 7 anticlockwise. Each gripper arm is rotated into a gap between two adjacent storage pouches. It is possible that a gripper arm will during this anticlockwise rotation hit against a holder of a halted storage pouch from above. The gripper arm then pushes the storage pouch to the left or to the right, i.e. in a direction parallel to the longitudinal axis LA and along the guide rails. In one embodiment, the holder has a type of saddle roof on top which makes it easier for the gripper arm to pass between two adjacent storage pouches.

The gripper arms are brought to a position in which the two cutouts of a storage pouch are located between two opposing gripping surfaces of two adjacent gripper arms. The gripper-arm swiveling unit V-Gf reduces the distance in each case between two adjacent gripper arms until the two opposing gripping surfaces of these gripper arms grip the mail item in the storage pouch through the cutouts. These distance reductions are carried out until each selected mail item is clamped between two adjacent gripping surfaces. Preferably, a force limitation is implemented such that a predefined maximum force is exerted on a mail item.

The holder swiveling unit V-Ha draws the gripper-arm holder Gf-Ha with the gripper arms away, parallel to the lateral faces of the storage pouches. The distances between the gripper arms remain unchanged such that the N+1 gripper arms hold the gripped mail items and extract the held mail items from the storage pouch, each mail item being extracted through the respective opening in the storage pouch.

Because, in the exemplary embodiment, each storage pouch is held by two parallel guide rails, this prevents a storage pouch also from being rotated during the extraction of a mail item and the mail item from jamming in the storage pouch.

The gripping tool Gw deposits the N+1 or N1/2+1 gripped mail items in a receiving unit Auf, e.g. in a container.

LIST OF REFERENCE CHARACTERS

| Reference character | Meaning |
|---|---|
| An | Drive for the storage pouches on the closed conveyor track Fb |
| Ab-an | Rising transition section with the guide rail Fs-Ub.2 |
| Auf | Receiving station for mail items which the gripping tool Gw has removed from storage pouches |
| Bae | Image analysis unit, deciphers an address in an image of a mail item |
| Bel.h | Loading station for loading storage pouches with tall mail items |
| Bel.n | Loading station for loading storage pouches with short mail items |
| Bo.1 | V-shaped base of the storage pouch Sp.1 |
| Bo.2 | V-shaped base of the storage pouch Sp.2 |
| DSp | Mail-item data store |
| Eb | Horizontal reference plane with which the bottom edges of the tall and short storage pouches are aligned |
| Ent | Unloading station with the gripping tool Gw |
| Fb | Closed conveyor track of the sorter Sort |
| Fs.1.1, Fs.1.2 | Guide rails for short storage pouches |
| Fs.2.1, Fs.2.2 | Guide rails for tall storage pouches |
| Fs-Ub.2 | Right-hand guide rail of the rising transition section Ab-an |
| FTE | Format separating device |
| Ge.a1.1, Ge.a1.2, Ge.a2.1, Ge.a2.2 | Gripping elements of the outer gripper arms Gf.a1, Gf.a2 |
| Ge.i1.1, Ge.i1.2, Ge.i2.1, Ge.i2.2 | Gripping elements of the inner gripper arms Gf.i1, Gf.i2 |
| Gf.a1, Gf.a2 | Outer gripper arms of the gripping tool Gw |
| Gf.i1, Gf.i2 | Inner gripper arms of the gripping tool Gw |
| Gf1.a1.1, Gf1.a1.2, . . . | Gripping surfaces on the gripping elements Ge.a1.1, Ge.a1.2, . . . of the outer gripper arms Gf.a1, Gf.a2 |
| Gf1.i1.1, Gf1.i1.2, . . . | Gripping surfaces on the gripping elements Ge.i1.1, Ge.i1.2, . . . of the inner gripper arms Gf.i1, Gf.i2 |
| Gf-Ha | Gripper-arm holder of the gripping tool Gw |
| Gw | Gripping tool of the unloading station Ent |
| Hal.1 | Storage-pouch holder of the short storage pouch Sp.1 |
| Hal.2 | Storage-pouch holder of the tall storage pouch Sp.2 |
| Hal.3 | Storage-pouch holder of the further tall storage pouch Sp.3 |
| Ka.n.1 Ka.n.2 | Imaging equipment for short mail items, in the form of two opposing cameras |
| Ka-o.1.1 Ka-o.2.2 | Top edges of the two lateral faces Sf.1.1, Sf.1.2 |
| Ka-u.1.1 Ka-u.1.2 | Bottom edges of the two lateral faces Sf.1.1, Sf.1.2 |
| Ka-o.2.1 Ka-o.2.2 | Top edges of the two lateral faces Sf.1.1, Sf.1.2 |
| Ka-u.2.1 | Bottom edges of the two lateral faces |

-continued

| Reference character | Meaning |
|---|---|
| Ka-u.2.2 | Sf.2.1, Sf.2.2 |
| Ka.h.1, Ka.h.2 | Imaging device for tall mail items, in the form of two opposing cameras |
| Ke-Sp.1, Ke-Sp.2 | Machine-readable identifiers of storage pouches Sp.1, Sp.2 |
| Kop.1.1, Kop.1.2 | Holding elements (coupling elements) of the short storage pouch Sp.1 |
| Kop.2.1, Kop.2.2 | Holding elements (coupling elements) of the tall storage pouch Sp.2 |
| Kop.3.1, Kop.3.2 | Holding elements (coupling elements) of the further tall storage pouch Sp.3 |
| LA | Longitudinal axis of the gripper arm holder Gf-Ha |
| N | Number of inner gripper arms of the gripping tool Gw |
| Ps.h | Tall flat mail item |
| Ps.n | Short flat mail item |
| SE | Control unit ("controller") |
| Sf.1.1, Sf.1.2 | Flat lateral faces of the storage pouch Sp.1 |
| Sf.2.1, Sf.2.2 | Flat lateral faces of the storage pouch Sp.2 |
| Sort | Sorter with the closed conveyor track Fb |
| Sp.1 | Storage pouch for short flat mail items |
| Sp.2 | Storage pouch for tall flat mail items |
| Sp.3 | Further storage pouch for tall flat mail items, located upstream of the rising section Ab-An |
| Spa.1, Spa.2 | Slot-shaped openings on the sides of the storage pouches Sp.1, Sp.2 |
| Ver.1, Ver.2 | Singulators of the feeding devices ZE.1, ZE.2 |
| V-Gf | Gripper-arm swiveling unit, can alter the distance between gripper arms of the gripping tool Gw |
| V-Ha | Holder swiveling unit, can rotate the gripper-arm holder Gf-Ha about the longitudinal axis La |
| ZE.n | Feeding device for short mail items |
| ZE.h | Feeding device for tall mail items |

The invention claimed is:

1. A sorting installation for sorting a plurality of articles according to a predefined sort characteristic, the sorting installation comprising:

a measuring device configured to measure, for each article to be sorted, what value the predefined sort characteristic assumes for the article;

a plurality of holding apparatuses;

at least one supply station configured to place a respective article to be sorted into a holding apparatus or otherwise detachably connect the article to said holding apparatus in such a way that, after the article has been placed into said holding apparatus, said holding apparatus holds the article as a held article;

a sorting and transporting device configured:

to transport said holding apparatuses together with the held articles to be sorted to the removal station; and during the transportation of the holding apparatuses, to place the holding apparatuses with the articles into a sequence;

wherein the sequence of the holding apparatuses so generated depends on the measured sort characteristic values of the articles in or on the holding apparatuses, and thereby to sort the held articles according to the predefined sort characteristic;

as a result of which said sorting and transporting device generates at least one holding-apparatus sequence of holding apparatuses with held articles; and at least one removal station configured to remove the articles to be sorted from the holding apparatuses;

said removal station having a gripping tool with at least two gripper arms disposed in a defined gripper-arm sequence, said gripping tool being configured to:

place said gripper arms between a plurality of holding apparatuses of a holding-apparatus sequence in such a way that:

in each case at least one holding apparatus is located between two adjacent gripper arms of said gripper-arm sequence; and said gripper arms of said gripper-arm sequence can simultaneously grip a total of at least two articles which are held by the same holding apparatus or by two different holding apparatuses; and alter a distance between two adjacent gripper arms such that the two gripper arms grip and temporarily retain between the two adjacent gripper arms each article in or on a holding apparatus; and said removal station being configured to remove simultaneously from the respective said holding apparatuses or otherwise to separate from said holding apparatuses the articles gripped in each case by two gripper arms, by way of a relative movement of said gripper arms relative to those holding apparatuses that are located in each case between at least two gripper arms of said gripping tool.

2. The sorting installation according to claim 1, wherein:

said gripper-arm sequence comprises at least one inner gripper arm and two outer gripper arms;

each said inner gripper arm that is located in said gripper-arm sequence between two other gripper arms has two gripping surfaces;

said two outer gripper arms each have at least one gripping surface;

in each case, one gripping surface of each inner gripper arm and at least one gripping surface of another gripper arm oppose one another such that said gripping tool is enabled to simultaneously grip at least two articles in or on two different holding apparatuses; and wherein in each case two opposing gripping surfaces:

exert on each article between said gripping surfaces two gripping forces acting anti-parallel; and thereby retain each article therebetween.

3. The sorting installation according to claim 2, wherein:

said gripping tool comprises a gripper-arm holder for said gripper arms, and a gripper-arm swiveling unit;

at least one inner gripper arm of said gripper-arm sequence is mounted on said gripper-arm holder;

said two other gripper arms are pivotally connected to said gripper-arm holder; and said gripper-arm swiveling unit is configured to pivot said two other gripper arms and, by way of such pivoting, to alter the distance between two opposing gripping surfaces.

4. The sorting installation according to claim 1, wherein:

each said holding apparatus comprises at least two lateral faces each extending in a lateral-face plane and said at least two lateral faces of a respective said holding apparatus enclosing a space;

each said supply station is configured to place an article to be sorted into a holding apparatus such that the article, after being placed into said holding apparatus, is located at least partially in the space enclosed by said lateral faces; and said gripping tool is configured such that in each case two adjacent gripper arms exert two forces acting antiparallel on each article in a holding apparatus which is located between the two adjacent gripper arms, wherein the forces act on the article from two sides into the enclosed space.

5. The sorting installation according to claim 4, wherein:

each said lateral face of each said holding apparatus is formed with a cutout;

said gripping tool is configured to grip and temporarily retain with in each case two adjacent gripper arms an article in said holding apparatus and wherein the two adjacent gripper arms:

grip the article in said holding apparatus through said two cutouts in said two lateral faces of said holding apparatus located between the adjacent said gripper arms; and temporarily retain the article gripped through said two cutouts.

6. The sorting installation according to claim 5, wherein said gripper arms lie in a gripper-arm plane, and the sorting installation further comprises:

an aligning unit configured to align a plurality of said holding apparatuses by their respective cutouts such that said cutouts lie in a predefined reference plane, at least when said holding apparatuses have reached said removal station; and wherein said reference plane is parallel to said gripper-arm plane.

7. The sorting installation according to claim 1, wherein said sorting installation is configured such that, during unloading, at least two filled holding apparatuses are simultaneously located between two adjacent said gripper arms of said gripper-arm sequence and said two adjacent said gripper arms exert two forces acting anti-parallel on each article in said holding apparatuses.

8. A method for sorting articles according to a predefined sort characteristic with a sorting installation, the sorting installation including:

a plurality of holding apparatuses and a gripping tool, wherein the gripping tool having at least two gripper arms disposed in a gripper-arm sequence; and the method comprising the following steps, to be executed for each article to be sorted:

measuring a value which the predefined sort characteristic assumes for the given article;

placing the article into a holding apparatus or otherwise detachably connecting the article to the holding apparatus; and placing the holding apparatuses together with the articles held thereby in a sequence;

to produce at least one holding-apparatus sequence of holding apparatuses with held articles;

the sequence of holding apparatuses depending on the measured sort-characteristic values of the articles in the holding apparatuses;

removing the article from the holding apparatus with the gripping tool and thereby executing the following steps:

the gripping tool moving the gripper arms between a plurality of holding apparatuses of a holding-apparatus sequence such that in each case at least one holding apparatus is located between two adjacent gripper arms of the gripper-arm sequence, and two adjacent gripper arms grip and temporarily clamp between them an article in or on the holding apparatus; and the gripper arms of the gripper-arm sequence simultaneously gripping a total of at least two articles held by holding apparatuses; and causing a relative movement of the gripper arms relative to those holding apparatuses which in each case are located between two gripper arms of the gripping tool, for simultaneously removing the articles gripped by each two gripper arms from the respective holding apparatuses or otherwise spatially separating the articles from the holding apparatuses.

* * * * *